US010378302B2

(12) United States Patent
Sinkewich et al.

(10) Patent No.: US 10,378,302 B2
(45) Date of Patent: Aug. 13, 2019

(54) DROP BALL SIZING APPARATUS AND METHOD

(71) Applicant: GLOBAL CORE TECHNOLOGIES CORP., Calgary (CA)

(72) Inventors: Robert Sinkewich, Calgary (CA); Joseph Watmough, Calgary (CA); Nigel Halladay, St. Austell (CA)

(73) Assignee: GLOBAL CORE TECHNOLOGIES CORP., Calgary (CA)

( * ) Notice: Subject to any disclaimer, the term of this patent is extended or adjusted under 35 U.S.C. 154(b) by 0 days.

(21) Appl. No.: 16/006,724

(22) Filed: Jun. 12, 2018

(65) Prior Publication Data

US 2019/0136654 A1 May 9, 2019

Related U.S. Application Data

(60) Provisional application No. 62/581,608, filed on Nov. 3, 2017.

(30) Foreign Application Priority Data

Nov. 23, 2017 (CA) ..... 2986665

(51) Int. Cl.

| | |
|---|---|
| ***E21B 33/068*** | (2006.01) |
| ***E21B 47/00*** | (2012.01) |
| *E21B 43/26* | (2006.01) |
| *E21B 33/12* | (2006.01) |

(52) U.S. Cl.

CPC ..... *E21B 33/068* (2013.01); *E21B 47/00* (2013.01); *E21B 33/12* (2013.01); *E21B 43/26* (2013.01)

(58) Field of Classification Search

CPC ..... E21B 33/068; E21B 47/00; E21B 33/12; E21B 43/26

See application file for complete search history.

(56) References Cited

U.S. PATENT DOCUMENTS

| | | | | |
|---|---|---|---|---|
| 3,186,502 | A * | 6/1965 | Rademacher | E21B 47/00 175/424 |
| 4,132,243 | A * | 1/1979 | Kuus | E21B 33/068 137/268 |
| 6,302,199 | B1 | 10/2001 | Hawkins et al. | |
| 8,636,055 | B2 | 1/2014 | Young et al. | |
| 9,109,422 | B2 | 8/2015 | Ferguson et al. | |
| 9,187,994 | B2 | 11/2015 | Themig | |
| 9,291,024 | B2 | 3/2016 | Artherholt et al. | |
| 9,291,025 | B2 | 3/2016 | McGuire | |
| 9,447,652 | B2 | 9/2016 | Artherholt et al. | |
| 2008/0223587 | A1* | 9/2008 | Cherewyk | E21B 33/068 166/386 |

(Continued)

FOREIGN PATENT DOCUMENTS

| | | |
|---|---|---|
| CA | 2914394 A1 | 7/2016 |
| CA | 2914395 A1 | 7/2016 |

(Continued)

*Primary Examiner* — Yong-Suk Ro

(74) *Attorney, Agent, or Firm* — Oyen, Wiggs, Green & Mutala LLP

(57) ABSTRACT

Apparatus and methods for measuring the size of a round object. Apparatus and methods for checking that a drop ball used in a well fracturing process has a predetermined diameter before being introduced into the wellbore.

37 Claims, 20 Drawing Sheets

(56) References Cited

U.S. PATENT DOCUMENTS

| | | | | |
|---|---|---|---|---|
| 2012/0152525 | A1* | 6/2012 | McGuire | E21B 33/068 166/193 |
| 2014/0246189 | A1* | 9/2014 | Beason | E21B 33/068 166/75.15 |
| 2016/0290087 | A1* | 10/2016 | Cherewyk | E21B 33/068 |
| 2017/0022777 | A1 | 1/2017 | Allen et al. | |

FOREIGN PATENT DOCUMENTS

| | | | |
|---|---|---|---|
| CA | 2914430 | A1 | 7/2016 |
| WO | 2016032657 | A1 | 3/2016 |

* cited by examiner

DROP BALL SIZING APPARATUS AND METHOD

REFERENCE TO RELATED APPLICATIONS

This application claims priority to Canadian patent application No. 2986665 filed 23 Nov. 2017 and the benefit of U.S. provisional patent application No. 62/581,608 filed 3 Nov. 2017. Both of these applications are incorporated by reference herein in their entireties for all purposes.

TECHNICAL FIELD

The present invention relates to apparatus and methods for sizing and sorting round objects. In some embodiments, methods and apparatus for ensuring that drop balls having only a desired diameter are introduced into a wellbore are provided. In some embodiments, such methods and apparatus are useful in carrying out multi-interval hydraulic fracturing of oil and gas wells.

BACKGROUND

Hydraulic fracturing is a well stimulation technique that uses pressurized liquid to fracture rock. A fracking fluid is injected at high pressure into a wellbore to create and stimulate fractures within rock formations to promote the production of hydrocarbons from the well.

It is common when carrying out hydraulic fracturing to use drop balls, often referred to as frac balls, to isolate multiple different zones for stimulation within a formation. A series of packers is inserted into the wellbore at spaced apart intervals for isolating one zone from an adjacent zone. A drop ball having a predetermined diameter is dropped through the wellbore to selectively engage one packer in order to prevent fluid flow through that packer. The zone above that packer is then isolated, and that isolated zone can be treated or stimulated by the injection of fracturing fluid, which enters the formation through perforations in the casing.

Subsequently, a drop ball having a second predetermined diameter is dropped to block a different packer, typically that is located uphole of the previously blocked packer, to isolate a different zone uphole of the second packer for stimulation. This process is repeated until all desired zones have been stimulated. It is noted that in horizontally drilled wells, a first zone that is uphole of an adjacent zone may be positioned horizontally rather than vertically adjacent to the first zone.

Typically, the packers are arranged within the wellbore so that the most downhole packer will be blocked by the drop ball having the smallest diameter, and the most uphole packer will be blocked by the drop ball having the largest diameter. The drop balls are thus generally introduced in order from the drop ball having the smallest diameter, through drop balls having successively increasing diameters, to the drop ball having the largest diameter. In some cases, the diameter of the drop balls increases by approximately 1/16 inch per successively dropped ball. In some cases, the diameter of the drop balls produced by some manufacturers has a tolerance of +0.000, −0.003 inches.

The order in which the drop balls are introduced into the wellbore is very important, as dropping a ball having an incorrect diameter into the wellbore (i.e. dropping the drop balls out of order of the intended sequence of drop ball diameters) interferes with the hydraulic fracturing process. The result of dropping a ball having an incorrect diameter into the wellbore may be that certain zones are not stimulated by hydraulic fracturing. This can result in potentially significant economic losses, as hydrocarbons that would have been recovered had the hydraulic fracturing been carried out correctly are not recovered.

Documents of potential interest with respect to the technology described in this specification include:

U.S. Pat. No. 6,302,199 to Hawkins et al.;
U.S. Pat. No. 8,636,055 to Young et al.;
U.S. Pat. No. 9,109,422 to Ferguson et al.;
U.S. Pat. No. 9,291,024 to Artherholt et al.;
U.S. Pat. No. 9,291,025 to McGuire;
U.S. Pat. No. 9,739,111 to Beason et al.;
U.S. Pat. No. 9,447,652 to Artherholt et al.;
US 2008/0223587 to Cherewyk; and
US 2017/0022777 to Allen et al.

There is a need for improved mechanisms and methods for ensuring that drop balls have the desired diameter before being introduced into a wellbore.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and Illustrative, not limiting in scope. In various embodiments, one or more of the above-described problems have been reduced or eliminated, while other embodiments are directed to other improvements.

One aspect of the invention provides an apparatus for introducing a drop ball into a wellbore. The apparatus has an inlet, an outlet that can be placed in fluid communication with the inlet, a measuring chamber interposing the outlet and the Inlet, a ball release support positioned to initially support the drop ball within the measuring chamber and actuable to allow the drop ball to move from the measuring chamber to the wellbore via the outlet, and a measuring piston actuable to contact an edge of the drop ball within the measuring chamber to measure a diameter of the drop ball.

In some aspects, the ball release support is provided as a component of a drop ball acceptance rejection unit which has a through pass channel positioned on a first side of the ball release support and which is actuable to independently align each of the ball release support and the through pass channel with the measuring chamber so that when the ball release support is aligned with the measuring chamber, the drop ball is retained within the measuring chamber, and when the through pass channel is aligned with the measuring chamber, the drop ball can pass into the wellbore.

In some aspects, the drop ball acceptance/rejection unit also has a reject channel positioned on a second side of the ball release support and is actuable to also independently align the reject channel with the measuring chamber so that, when the reject channel is aligned with the measuring chamber, the drop ball can pass out of the measuring chamber but is prevented from entering the wellbore.

In some aspects, the apparatus for introducing a drop ball into a wellbore has a measuring unit that is configured to measure the displacement of the measuring piston or any element connected in fixed relation to the measuring piston in order to determine the diameter of the drop ball. In some aspects, the measuring unit is a linear potentiometer.

In some aspects, the measuring piston is actuated by a mechanical actuator having an electric motor, a first gear wheel operatively coupled to be rotated by the electric motor, a second gear wheel engaged to be rotated by rotation of the first gear wheel, a captive roller nut supported against longitudinal or lateral movement by a housing, the captive roller nut being operatively engaged to be rotated by rotation of the second gear wheel, and a threaded shaft portion in threaded engagement with the captive roller nut and supported against lateral and rotational movement but being longitudinally moveable in response to rotation of the captive roller nut. The threaded shaft portion is engaged to move the measuring piston in the longitudinal direction to extend and retract the measuring piston.

In some aspects, the apparatus has an indicator mechanism to provide a visual confirmation of whether a drop ball has been introduced into the wellbore. In some aspects, the indicator mechanism has a rear plate having a longitudinally extending straight slot defined therein, a front plate having an articulated slot defined therein, the front plate being rotatably mounted to the rear plate, and an indicator positioned to be rotated by rotation of the front plate.

In some aspects, methods of measuring an outer diameter of a round object are provided. In some aspects, a method of injecting a drop ball into a wellbore is provided. The method includes providing the drop ball to a measuring chamber, initially holding the drop ball in the measuring chamber, measuring a diameter of the drop ball by actuating a measuring piston to contact the drop ball and force the drop ball against a downstream surface of the measuring chamber, evaluating whether the drop ball has the desired diameter and, if the drop ball has the desired diameter, releasing the drop ball from the measuring chamber into the wellbore.

In some aspects, if it is determined that the drop ball does not have the desired diameter, the method includes a step of releasing the drop ball from the measuring chamber through a reject channel so that the drop ball is prevented from entering the wellbore.

In some aspects, the method includes providing a mechanical indication that the drop ball has been released from the measuring chamber into the wellbore, or from the measuring chamber into the reject channel such that the drop ball has not entered the wellbore.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is Intended that the embodiments and figures disclosed herein are to be considered illustrative rather than restrictive.

FIG. 2A shows the drop ball sizing unit in its fully retracted configuration. FIG. 2B shows the drop ball sizing unit in its fully extended configuration. FIG. 2C shows the drop ball sizing unit with the measuring piston extended to a position sufficient to confirm the diameter of a relatively small drop ball. FIG. 2D shows the drop ball sizing unit with the measuring piston extended to a position sufficient to confirm the diameter of a relatively large drop ball.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an Illustrative, rather than a restrictive, sense.

As used herein, the term "longitudinal" means a direction along a length of a component. The term "lateral" means a direction along a width of a component, i.e. In a direction perpendicular to the longitudinal direction.

As used herein, the term "downstream" means in a direction towards a first side of a measuring chamber, which is the side of the measuring chamber that is contacted by the measuring bar of a measuring piston as described herein when the measuring piston is in its fully extended configuration. The term "upstream" means in the opposite direction to the downstream direction, i.e. In a direction towards a second side of a measuring chamber, which is the side of the measuring chamber that is contacted by or positioned closest to the measuring bar of the measuring piston when the measuring piston is in its fully retracted configuration.

In some embodiments, an apparatus that provides a mechanical Interface between a drop ball release device and a fracturing fluid stream in a wellbore is provided. The apparatus intercepts the drop ball prior to Introduction to the wellbore and measures the diameter of the drop ball. If the drop ball has the predetermined diameter, the apparatus allows the drop ball to be released into the wellbore. If the drop ball does not have the predetermined diameter, the apparatus rejects the drop ball and does not permit the drop ball to be released into the wellbore.

Figure 1:
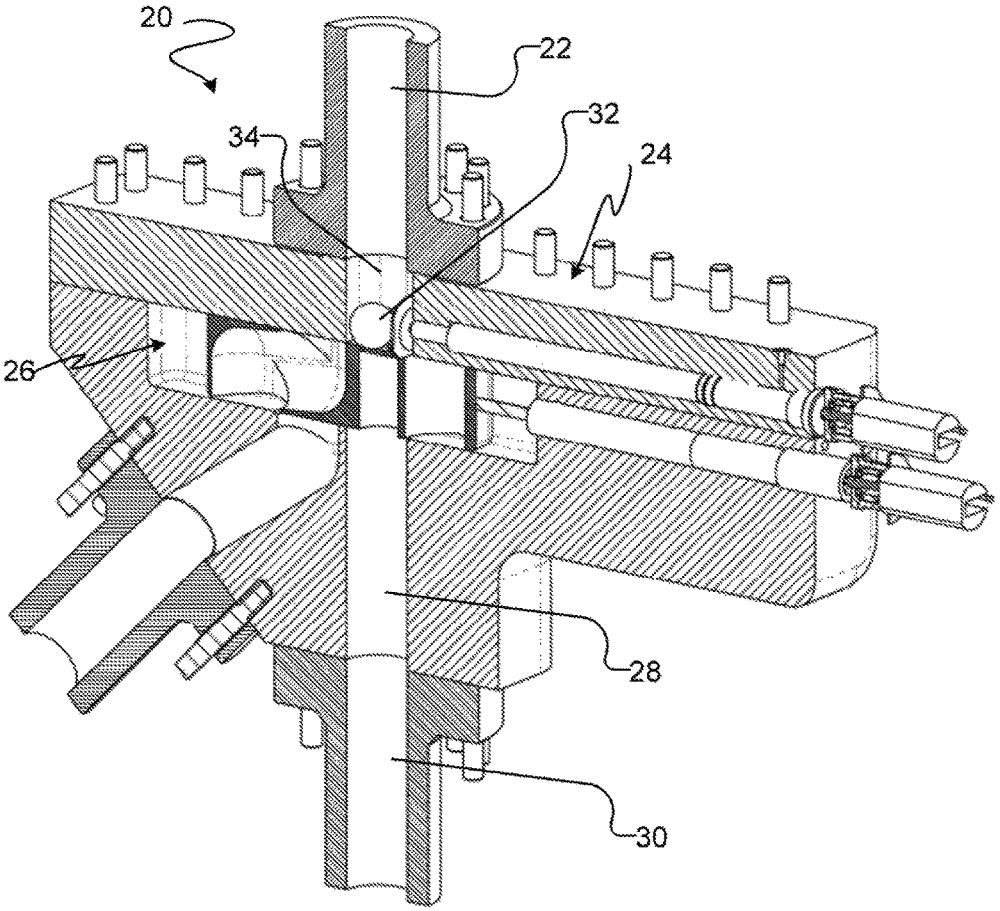
FIG. 1 shows a perspective isometric view of a drop ball sizing apparatus according to an example embodiment.

With reference to FIG. 1, an isometric cross-sectional view of an example embodiment of a drop ball sizing apparatus 20 is shown. Drop ball sizing apparatus 20 has a drop ball inlet 22, a drop ball sizing unit 24, a drop ball acceptance/rejection unit 26, and a drop ball outlet 28. The drop ball inlet 22 can be placed into fluid communication with the drop ball outlet 28 via the actuation of the drop ball acceptance/rejection unit 26 as disclosed herein. The various elements of the apparatus are mechanically connected and hydraulically sealed with respect to each other.

In some embodiments, drop ball Inlet 22 is connected to a drop ball launcher stack (not shown) that sequentially releases drop balls. In alternative embodiments, any suitable method or mechanism can be used to provide drop balls to drop ball Inlet 22 in the desired sequence, for example automated or manual ball injection methods.

Drop ball outlet 28 is configured to release the drop ball from drop ball sizing unit 24 into the wellbore 30 after the drop ball has been accepted by drop ball acceptance/rejection unit 26.

Drop ball inlet 22 is configured to receive a drop ball 32 and pass drop ball 32 to drop ball sizing unit 24. Drop ball 32 is received within a measuring chamber 34 of drop ball sizing unit 24. With reference to FIGS. 2A, 2B, 2C and 2D, the structure and operation of drop ball sizing unit 24 are Illustrated in greater detail.

Drop ball sizing unit 24 has a measuring piston 36 that is actuated to verify the diameter of a drop ball positioned within measuring chamber 34. The diameter of drop ball 32 is verified by measuring the displacement of measuring piston 36 when it is positioned against the outer diameter of a drop ball 32 that is positioned within measuring chamber 34 as described below. In some embodiments, measuring piston 36 is pressure balanced such that variations in the well pressure have a minimal effect upon the force required to move it.

Measuring piston 36 is provided at its distal end with a generally planar measuring bar 38. As best seen in FIG. 2D with reference to large drop ball 32A, measuring bar 38 is oriented within measuring chamber 34 in such a way as to tangentially contact a drop ball contained within measuring chamber 34 at its outer diameter at a point 40 directly opposite a point 42 of the drop ball that contacts downstream surface 44 of measuring chamber 34. In this way, when measuring bar 38 is extended to contact a drop ball at point 40, measuring piston 36 can be used to measure the diameter (illustrated as 48A or 48B) of the drop ball.

Downstream surface 44 provides a generally planar surface, at least at the points where it would be expected to contact a drop ball 32. Measuring bar 38 extends generally parallel to downstream surface 44 of measuring chamber 34, so that measuring bar 38 can be used to reasonably accurately measure the diameter of a drop ball positioned within measuring chamber 34, regardless of the diameter of the drop ball. In this manner, downstream surface 44 and measuring bar 38 act effectively as the two anvils of a caliper that can be used to accurately measure the diameter of a drop ball within measuring chamber 34 by measuring the relative displacement of measuring piston 36.

Figure 2A:
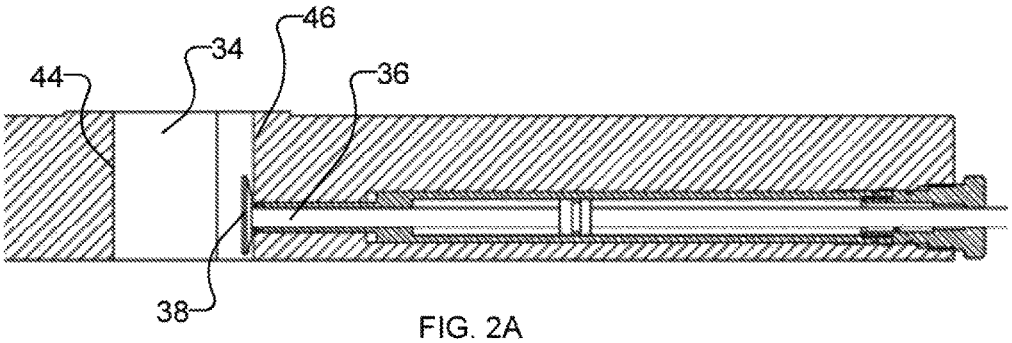
FIGS. 2A, 2B, 2C, and 2D show sectional views of a drop ball sizing unit according to an example embodiment in various configurations.

As can be seen in FIG. 2A, when measuring piston 36 is in the fully retracted position, measuring bar 38 is positioned proximate to the upstream surface 46 of measuring chamber 34. Measuring chamber 34 is thus ready to receive a drop ball 32 of any diameter which can fit within measuring chamber 34.

Figure 2B:
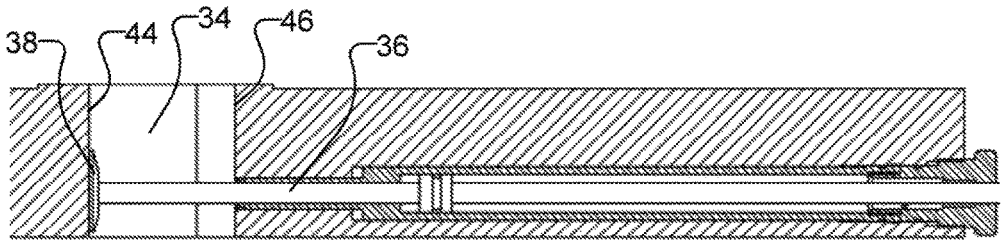

With reference to FIG. 2B, measuring piston 36 is shown in its fully extended or "zero check" position. In this configuration, measuring bar 38 is positioned adjacent to downstream surface 44 of measuring chamber 34. In some embodiments, measuring piston 36 is calibrated to its zero diameter position when measuring piston 36 is in this fully extended position. In some embodiments, as described in greater detail below, measuring piston 36 is moved to its fully extended or "zero check" position to confirm that a drop ball 32 previously held in measuring chamber 34 has been properly released.

Figure 2C:
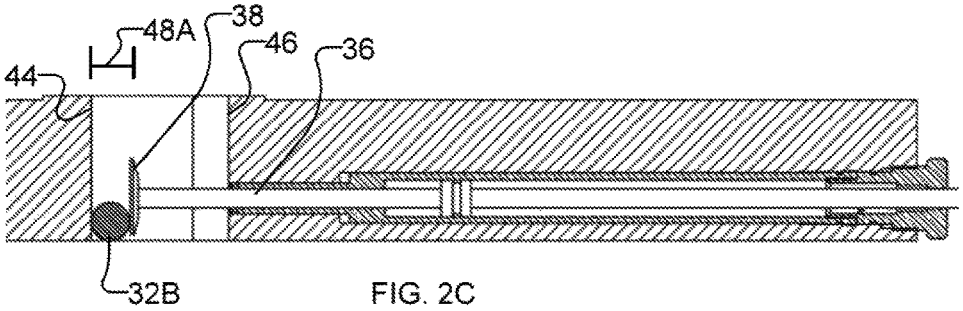
Figure 2D:
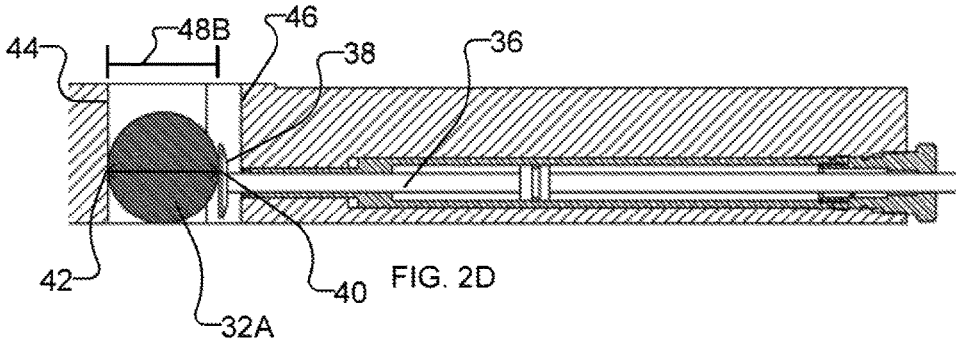

With reference to FIG. 2C, measuring piston 36 is shown in the position it would be in if measuring the diameter of a relatively small diameter drop ball 32B. In one example embodiment, relatively small diameter drop ball 32B has a diameter 48A of ¾ inch. Measuring bar 38 thus contacts the outer edge of drop ball 32B at a point approximately ¾ inch from downstream surface 44.

With reference to FIG. 2D, measuring piston 36 is shown in the position it would be in if measuring the diameter 48B of a relatively large diameter drop ball 32A. In one example embodiment, relatively large diameter drop ball 32A has a diameter of 4.5 inches. Measuring bar 38 thus contacts the outer edge of drop ball 32A at a point approximately 4.5 Inches from downstream surface 44.

Measuring piston 36 can be actuated in any suitable manner. For example, in some embodiments, measuring piston 36 is actuated electrically, pneumatically or hydraulically. Measuring piston 36 could be actuated in any suitable manner in alternative embodiments, for example mechanically, manually or magnetically.

The displacement of measuring piston 36 when it contacts the outer edge of a drop ball 32 is measured in any suitable manner in order to calculate the diameter of a drop ball 32 positioned within measuring chamber 34. In some embodiments, as described in greater detail below, the displacement of an actuator used to move measuring piston 36 is measured and used to calculate the diameter of drop ball 32.

In some embodiments, including the illustrated embodiment, after the diameter of drop ball 32 has been measured, drop ball 32 is passed to drop ball acceptance/rejection unit 26, shown in FIGS. 3A, 3B, 3C and 3D. Drop ball acceptance/rejection unit 26 has a selector plate 50, which is used to regulate the path of travel of drop ball 32, i.e. to control whether drop ball 32 is released through drop ball outlet 28 into wellbore 30, or whether drop ball 32 is rejected and prevented from entering wellbore 30.

As can be seen from FIG. 1, drop ball 32 is initially supported above selector plate 50 by a support panel 52 provided in a middle portion of selector plate 50. In the illustrated embodiment, support panel 52 is provided as a planar surface on which drop ball 32 can be supported. In some embodiments, including the illustrated embodiment, support panel 52 is ported, i.e. provided with a plurality of apertures 53 therethrough, through which liquid can pass.

Adjacent to support panel 52 on opposite sides thereof are respectively through pass channel 54 and reject channel 56. Each one of through pass channel 54 and reject channel 56 can define a path of travel for a drop ball 32 to move from the upper edge of selector plate 50 and be passed therethrough when the respective channel is aligned with measuring chamber 34.

Selector plate 50 is moveable with one degree of freedom within a chamber 60 of drop ball acceptance/rejection unit 26 so that through pass channel 54 can be aligned with both measuring chamber 34 and drop ball outlet 28 to allow ball 32 to enter outlet 28, and so that reject channel 56 can be aligned with both measuring chamber 34 and a reject outlet 62 of drop ball sizing apparatus 20 to allow drop ball 32 to be passed out of reject outlet 62 and in turn to prevent that particular drop ball 32 from entering wellbore 30. The position of selector plate 50 in which through pass channel 54 is aligned with drop ball outlet 28 and measuring chamber 34 is referred to herein as the "accept configuration", shown in FIG. 3C. The position of selector plate 50 in which reject channel 56 is aligned with reject outlet 62 and measuring chamber 34 is referred to herein as the "reject configuration", shown in FIG. 3D.

Figure 3A:
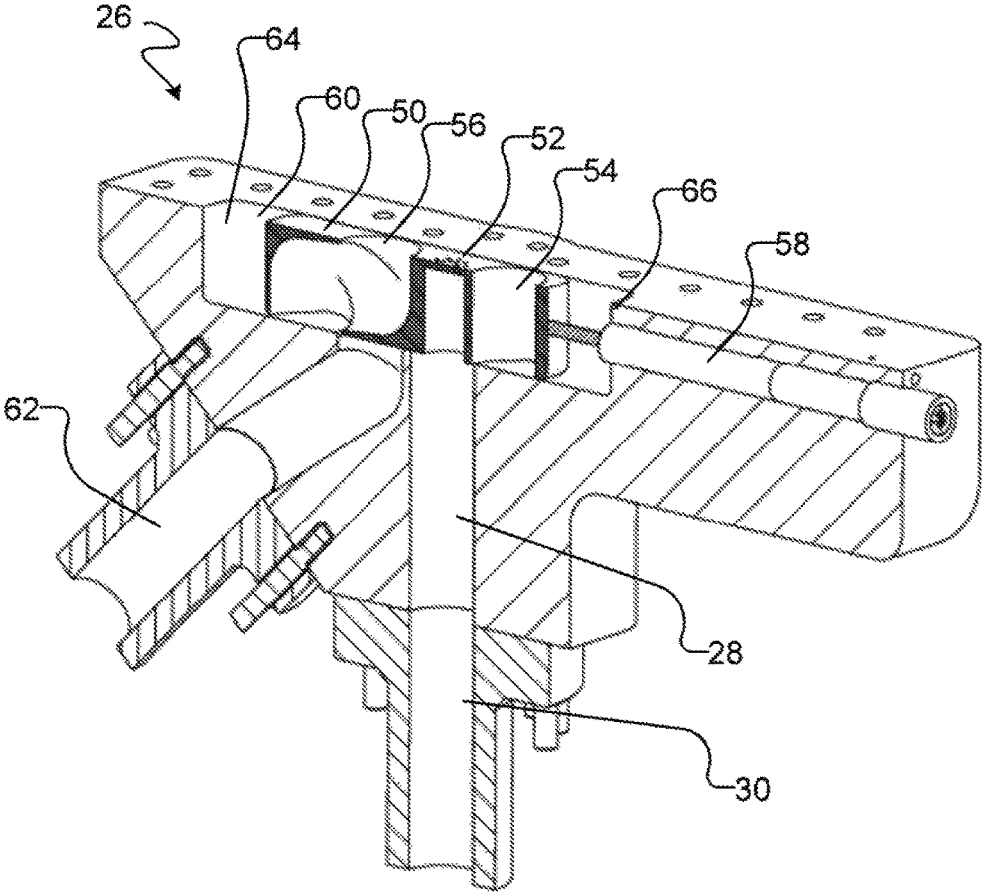
FIG. 3A is a sectional view of a drop ball acceptance/rejection unit according to one example embodiment.
Figure 3B:
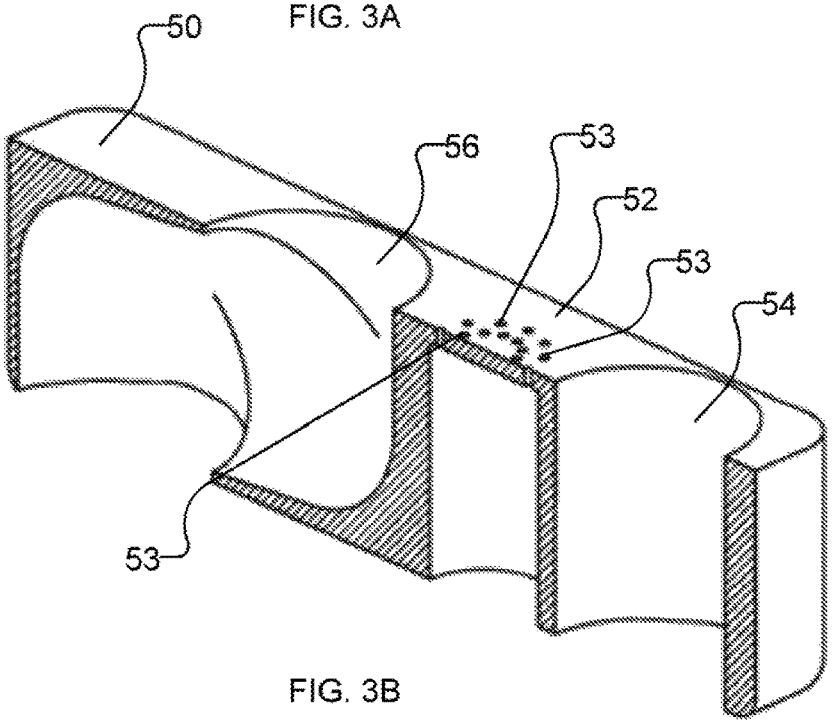
FIG. 3B is a sectional view of a selector plate from the embodiment of FIG. 3A.
Figure 3C:
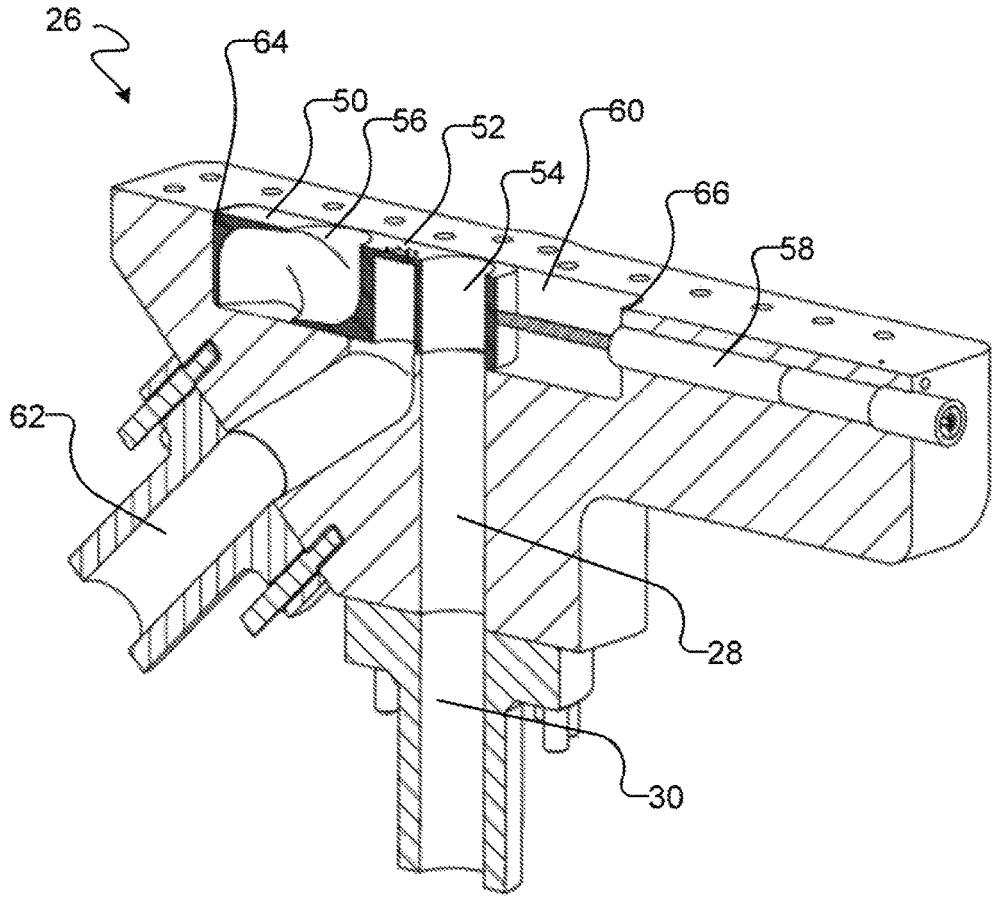
FIG. 3C is a sectional view of the embodiment of FIG. 3A in an accept configuration.
Figure 3D:
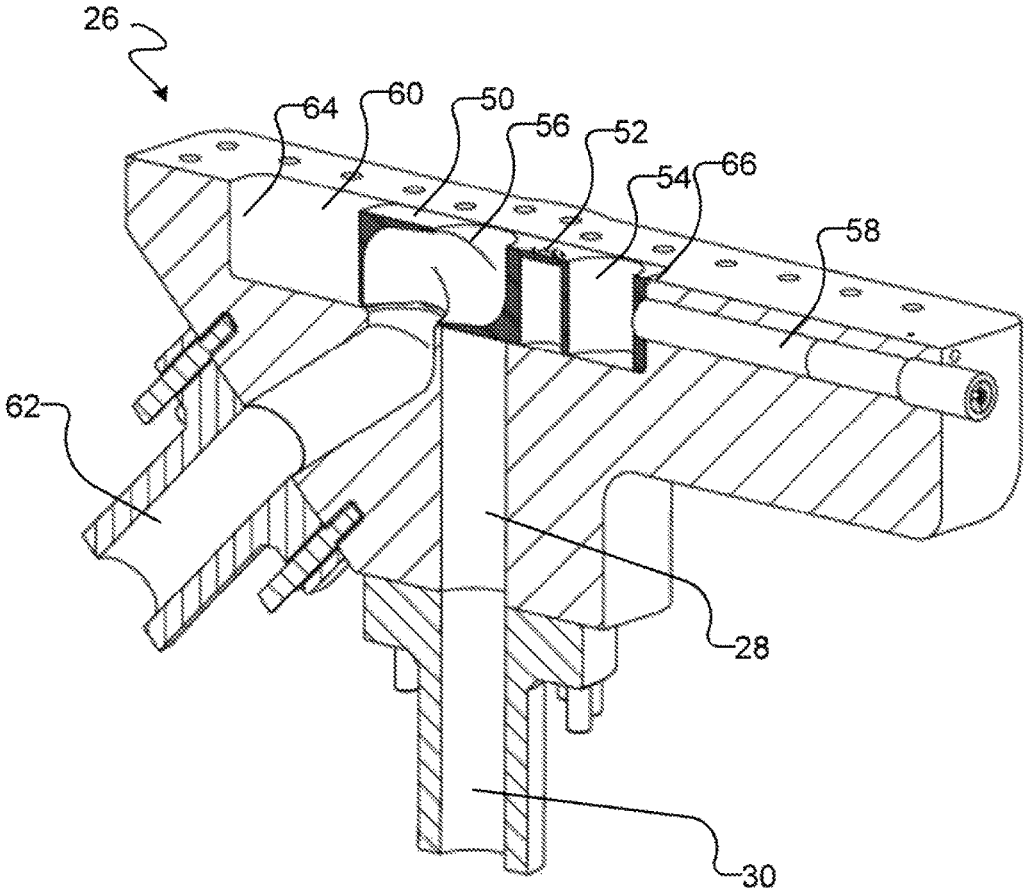
FIG. 3D is a sectional view of the embodiment of FIG. 3A in a reject configuration.

Initially, selector plate 50 is in a "hold configuration", shown in FIG. 3A. In the hold configuration, selector plate 50 is positioned to hold a drop ball 32 within measuring chamber 34 as shown in FIG. 1. As illustrated, in the hold configuration, support panel 52 interposes measuring chamber 34 and drop ball outlet 28. From this position, selector plate 50 can be actuated to move selector plate 50 to either the accept configuration or the reject configuration, depending on whether drop ball 32 has been determined to have the desired diameter or not.

Any suitable mechanism is provided to actuate selector plate 50 within a chamber 60 of drop ball acceptance/rejection unit 26. In the illustrated embodiment, a drive piston 58 is provided that can be actuated to slide selector plate 50 within chamber 52.

In the illustrated embodiment, if selector plate 50 is moved in the downstream direction towards the downstream surface 64 of chamber 60, then through pass channel 54 is brought into alignment with drop ball outlet 28 and measuring chamber 34 to place selector plate 50 in the accept configuration and allow drop ball 32 to enter drop ball outlet 28 and hence wellbore 30.

In contrast, if selector plate 50 is moved in the upstream direction towards the upstream surface 86 of chamber 60, then reject channel 56 is brought into alignment with reject outlet 62 and measuring chamber 34 to place selector plate 50 in the reject configuration, and drop ball 32 is diverted from entering drop ball outlet 28 (and hence drop ball 32 is prevented from entering wellbore 30).

Drive piston 58 can be actuated in any suitable manner to slide selector plate 50 as outlined above, for example by using an electric, hydraulic or pneumatic actuator. Drive piston 58 could be actuated in any suitable manner in alternative embodiments, for example mechanically, manually or magnetically.

With reference to FIGS. 4A, 4B, 4C, 4D, 4E, and 4F, an example embodiment of a drive mechanism 100 that can be used to actuate either or both of measuring piston 36 and selector plate 50 is illustrated as but one example of a suitable mechanism that can be used. Drive mechanism 100 further includes an apparatus for measuring the displacement of measuring piston 36, although the apparatus for measuring the displacement of measuring piston 36 need not be provided as part of drive mechanism 100 in alternative embodiments.

In the illustrated embodiment, drive mechanism 100 is an electric actuator having a main drive shaft 102 and a motor drive assembly 104. A measuring unit 106 is provided on drive mechanism 100 to measure the distance traveled by the main drive shaft 102. In alternative embodiments, measuring unit 106 can be provided in any suitable location that will enable it to measure the displacement of measuring piston 36 in the longitudinal direction.

Figure 4A:
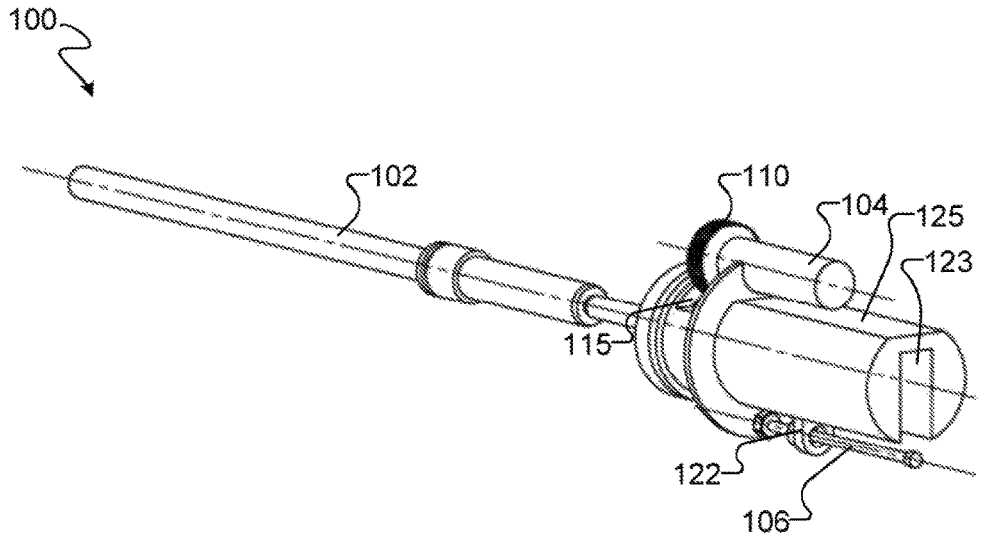
FIG. 4A is an isometric view of a drive mechanism used to actuate the measuring piston in one example embodiment.
Figure 4B:
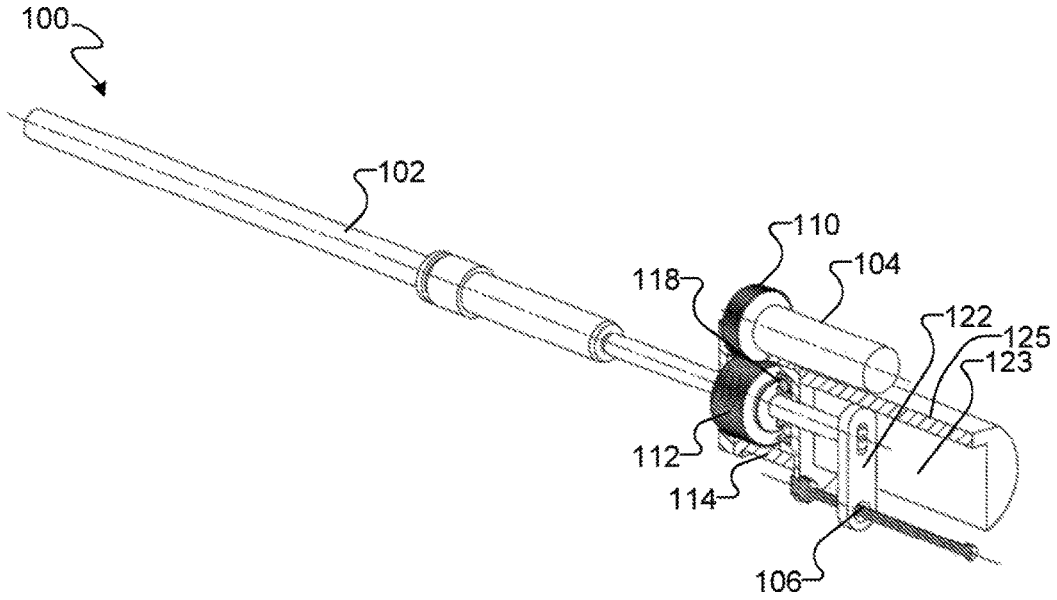
FIG. 4B is an isometric partially cut-away view thereof.
Figure 4C:
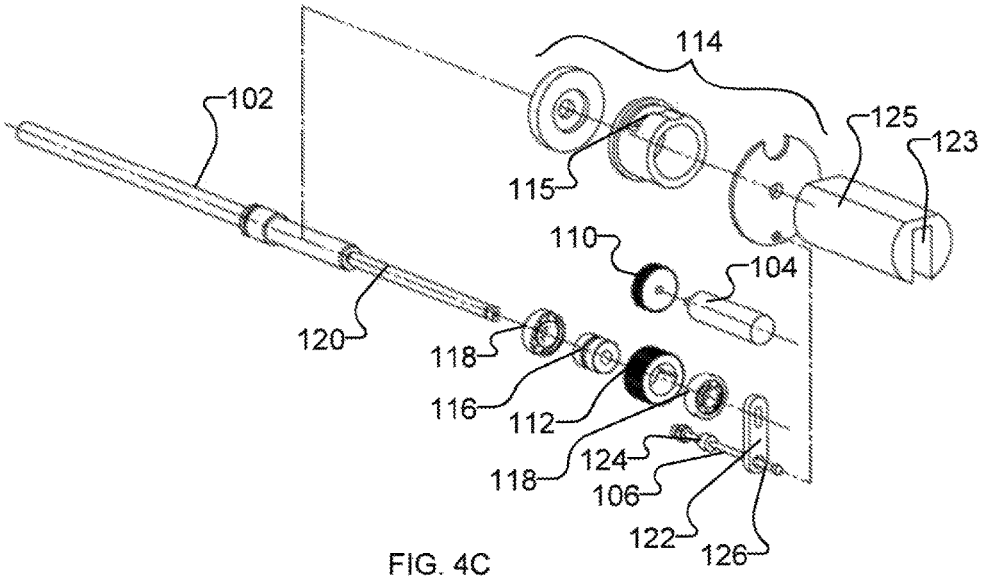
FIG. 4C is an exploded view thereof.
Figure 4D:
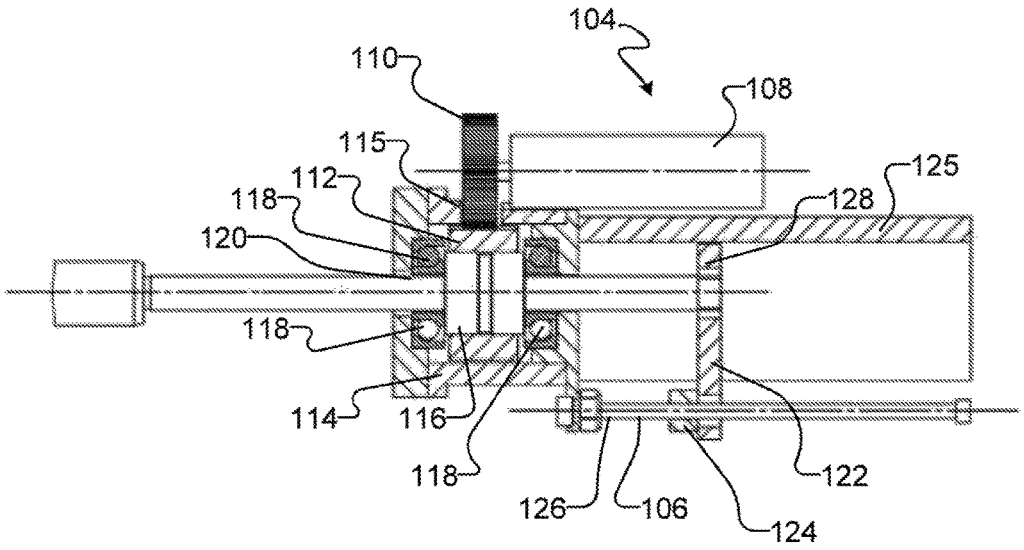
FIG. 4D is a sectional view thereof.
Figure 4E:
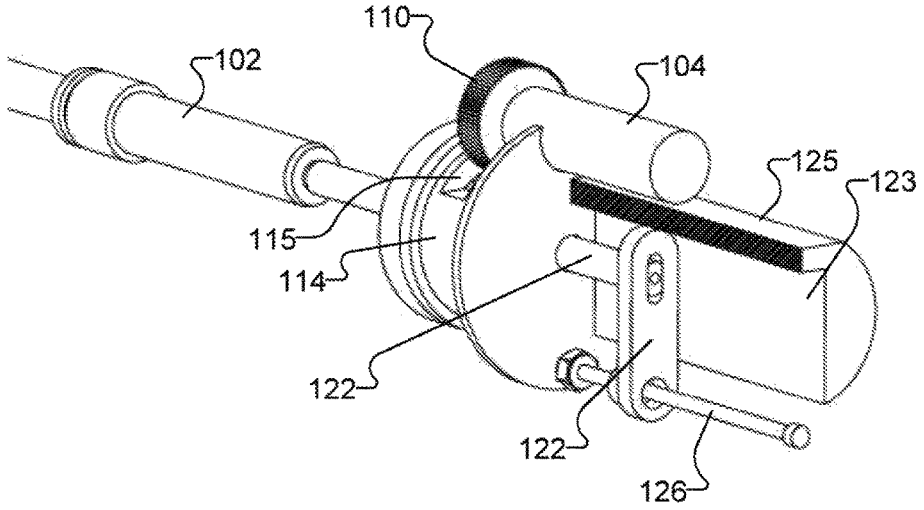
FIGS. 4E and 4F are partially cut away views showing the measuring unit thereof.
Figure 4F:
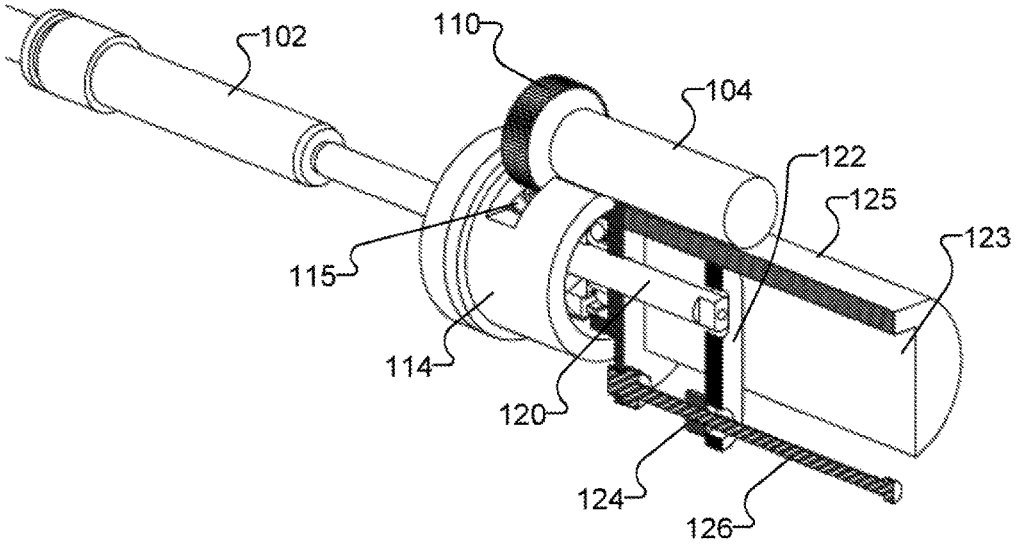

As best seen in FIG. 4D, the motor drive assembly 104 has an electric motor 108 that is engaged to drive a first gear wheel 110. First gear wheel 110 in turn rotates a second gear wheel 112, which is housed within a housing assembly 114. Housing assembly 114 includes an aperture 115 formed therethrough so that first gear wheel 110 can access and rotate second gear wheel 112.

A captive roller nut 116 is engaged to be rotated by second gear wheel 112, and is also in threaded engagement with a threaded shaft portion 120 that is connected to main drive shaft 102. Captive roller nut 116 is supported within housing assembly 114 so that it can freely rotate, but so that it cannot move in the longitudinal or lateral directions.

Threaded shaft portion 120 is supported within housing assembly 114 by a plurality of thrust bearings 118 that permit threaded shaft portion 120 to move longitudinally, while preventing lateral movement of threaded shaft portion 120. Rotational movement of threaded shaft portion 120 is precluded by an anti-rotation key plate 122, which can slide longitudinally within a slot 123 formed within an external housing 125 but cannot rotate therein.

Threads on the outer surface of threaded shaft portion 120 are threadedly engaged with corresponding threads on the Internal surface of captive roller nut 116, so that rotation of captive roller nut 116 (which cannot move in the lateral or longitudinal directions) moves threaded shaft portion 120 longitudinally. Threaded shaft portion 120 can move only in the longitudinal direction in response to the rotation of captive roller nut 116, and is prevented from rotating about its axis by key plate 122. Thus, rotation of captive roller nut 116 causes threaded shaft portion 120 to move in either the downstream direction (i.e. to drive measuring bar 38 towards the downstream surface 44 of measuring chamber 34) when captive roller nut 116 is rotated in a first direction, or the upstream direction (i.e. to move measuring bar 38 towards upstream surface 46 of measuring chamber 34) when captive roller nut 116 is rotated in a second direction that is opposite to the first direction.

Actuation of electric motor 108 in a first direction thus rotates first gear wheel 110 to drive threaded shaft portion 120 in a first longitudinal direction (e.g. downstream). Actuation of electric motor 108 in a second direction correspondingly rotates first gear wheel 110 to drive threaded shaft portion 120 an a second longitudinal direction opposite to the first longitudinal direction (e.g. upstream).

Because measuring piston 36 is fixedly connected to threaded shaft portion 120 via main shaft 102, in some embodiments including the illustrated embodiment of FIGS. 4A-4F, the distance that measuring piston 36 has traveled can be measured by measuring the longitudinal displacement of threaded shaft portion 120. Thus, in one example embodiment, measuring bar 38 of measuring piston 36 can be advanced to contact downstream surface 44 of measuring chamber 34. This is the fully extended configuration or "zero check" position of drop ball sizing apparatus 20, and can be used to calibrate the location of measuring bar 38 at a zero diameter ball position. Then, when measuring piston 36 is actuated so as to contact the edge of a drop ball 32 within measuring chamber 34, the difference in position from the zero check position can be calculated, to thereby determine the diameter of that particular drop ball 32.

The longitudinal displacement of threaded shaft portion 120 or measuring piston 36 can be measured in any suitable manner. In the illustrated embodiment, the longitudinal displacement of threaded shaft portion 120 is measured by using a linear potentiometer to provide measuring unit 106. An anti-rotation key plate 122 is provided to prevent rotation of threaded shaft portion 120, and supports a wiper 124 of the linear potentiometer so that it can slide along a resistive element 126 of the linear potentiometer as threaded shaft portion 120 moves in the longitudinal direction. Resistive element 126 is held fixed relative to threaded shaft portion 120.

A second end 128 of anti-rotation key plate 122 is fixed to threaded shaft portion 120, so that anti-rotation key plate (and therefore wiper 124) move together with threaded shaft portion 120 as it is displaced in the longitudinal direction. The resistive element 126 of the linear potentiometer is held in place by engagement with housing assembly 114 and cannot move in the longitudinal direction. Thus, the linear potentiometer can be used to measure the displacement of threaded shaft portion 120 and thus the displacement of measuring piston 38 and measuring bar 38 within measuring chamber 34.

While in the Illustrated embodiment a linear potentiometer has been illustrated as the measuring unit 106, in alternative embodiments, any suitable method for measuring the displacement of threaded shaft portion 120 and/or measuring bar 38 could be used.

For example, in some embodiments, the number of rotations through which captive roller nut 116 has turned is used to measure the corresponding longitudinal displacement of threaded shaft portion 120. In some embodiments, both the number of rotations through which captive roller nut 116 has turned and the longitudinal displacement as measured by the linear potentiometer (or other distance measuring apparatus used) are both monitored, and the number of rotations through which captive roller nut 116 has turned is used to cross-check or verify the displacement as measured by the linear potentiometer (or other distance measuring apparatus used).

In some embodiments, the voltage of electric motor 108 can be measured and monitored to determine the longitudinal displacement of threaded shaft portion 120.

In some embodiments, electromagnetic sensors or ultrasonic sensors are used to measure the displacement of threaded shaft portion 120, measuring piston 36, measuring bar 38, or any other component connected in fixed relation to these components.

In alternative embodiments, the longitudinal displacement of threaded shaft portion 120, measuring piston 36, measuring bar 38, or any other component connected in fixed relation to at least one of these components, is measured using a linear variable differential transformer (LVDT), a combination of a stepper motor with a threaded shaft and the use of a tachometer and encoder, mechanical means (for example, by using a ruler or micrometer), or by measuring hydraulically displaced volume of a hydraulic actuator.

In alternative embodiments, the longitudinal displacement of threaded shaft portion 120, measuring piston 36, measuring bar 38, or any other component connected in fixed relation to at least one of these components, is measured in any other suitable manner to calculate the diameter of a drop ball 32 held within measuring chamber 34.

In alternative embodiments, measuring unit 106 is placed in any suitable location to measure the displacement of any component that is in fixed relation to measuring bar 36. That is, measuring unit 106 does not have to be associated with drive mechanism 100 as shown in FIGS. 4A-4F. For example, with reference to FIGS. 5A, 5B and 5C, an alternative embodiment is illustrated in which a linear potentiometer 106' is used to provide the measuring unit, and the linear potentiometer 106' is provided to measure the displacement of measuring shaft 38'. In the illustrated embodiment of FIGS. 5A-5C, the components of the drop ball sizing apparatus are generally similar to those of drop ball sizing apparatus 20, and like elements are referred to with like reference numerals and their function is not described again.

Figure 5A:
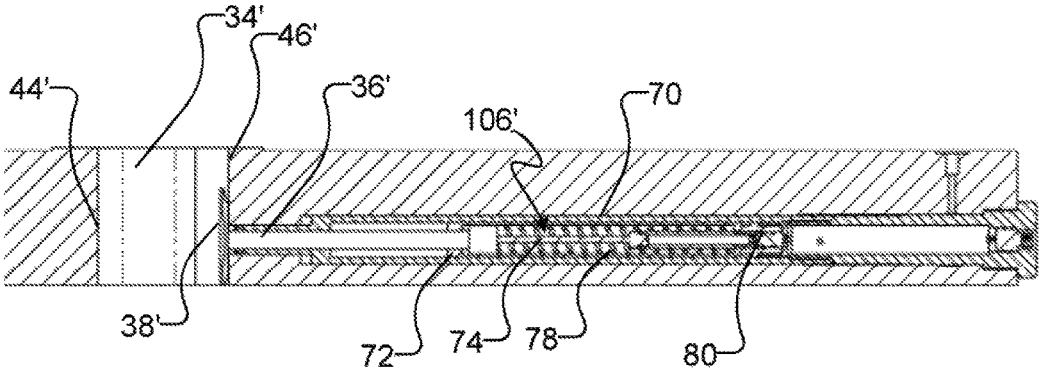
FIG. 5A is a partial sectional view of an example embodiment having a "soft touch" measuring piston in its fully retracted configuration.
Figure 5B:
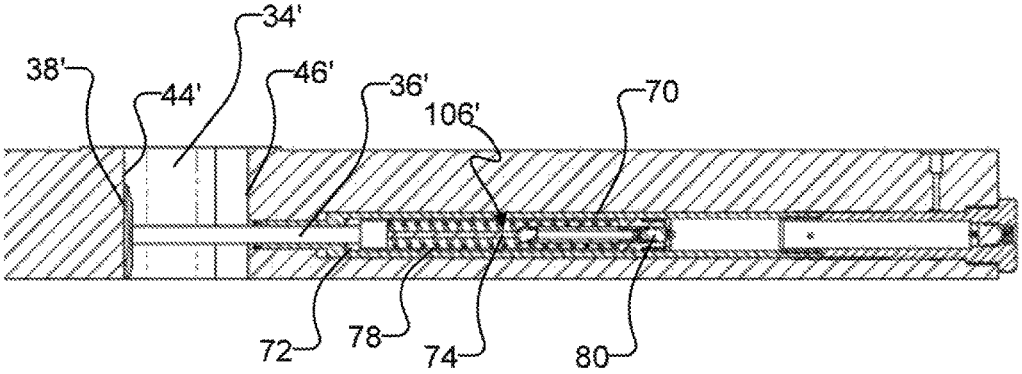
FIG. 5B is a partial sectional view thereof with the measuring piston in its fully extended configuration.
Figure 5C:
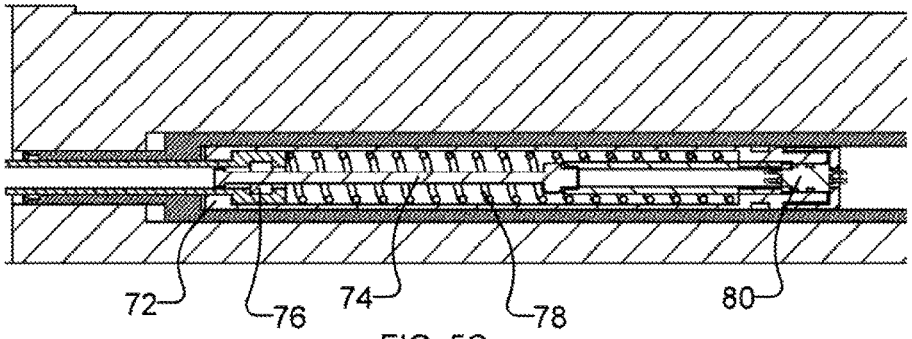
FIG. 5C is an enlarged partial sectional view thereof.

The embodiment illustrated in FIGS. 5A-5C includes a "soft touch" mechanism to regulate the force that is applied against a drop ball 32 by measuring piston 36' while its diameter is being measured. In particular, the force placed upon the drop ball 32 is determined by the properties of a spring mechanism only, and is not determined by the drive mechanism 100 or other structure used to actuate measuring piston 36'. In some embodiments in which the drop balls to be measured are made of a material that may be susceptible to being dented, fractured or scratched by the measuring piston, a measuring piston 36' may be preferred.

In the embodiment illustrated in FIGS. 5A-5C, measuring piston 36' is supported by an internal drive sleeve assembly 72 mounted within an outer sleeve 70. Internal drive sleeve assembly 72 is slidable longitudinally within outer sleeve 72. Internal drive sleeve assembly 72 moves longitudinally in the downstream or upstream direction in response to force applied by an actuator (e.g. a mechanical actuator similar to drive mechanism 100, or another type of mechanical, pneumatic, hydraulic, electric, manual or other suitable type of actuator) to the upstream end of internal drive sleeve assembly 72, e.g. adjacent to electrical feedthrough 80.

An internal potentiometer 74 having a wiper 76 (best seen in FIG. 5C) is provided within internal drive sleeve assembly 72. Internal potentiometer 74 is used to measure the position of measuring piston 36' with respect to inner drive sleeve assembly 72.

Measuring piston 36' is mounted in a spring loaded fashion within Inner drive sleeve assembly 72. In the illustrated embodiment, the spring force against measuring piston 36' is provided by a helical coil spring 78. In alternative embodiments, any suitable mechanism that can apply a biasing force against measuring piston 36' could be used in place of coil spring 78 to mount measuring piston 36' in a spring loaded fashion. The biasing force applied by coil spring 78 biases measuring piston 36' in the downstream direction. In the illustrated embodiment of FIGS. 58 and 5C, measuring piston 36' is shown at the zero position, near its downstream limit of travel. Inner drive sleeve assembly 72 is likewise near its downstream limit of travel in these figures. FIG. 5A shows internal drive sleeve assembly 72 and measuring piston 36' at their fully upstream position.

When a drop ball 32 is present within measuring chamber 34', measuring piston 36' comes to rest at a relatively more upstream position within measuring chamber 34' due to the presence of drop ball 32. However, the internal drive sleeve assembly 72 is forced to its full downstream position during any measuring step. Thus, the difference in displacement of measuring piston 36' when a drop ball is present within measuring chamber 34' is measured by internal potentiometer 74.

In the illustrated embodiment, internal potentiometer 74 outputs electrical signals which are passed through an electrical feedthrough 80 to report the measured diameter of drop ball 32. In alternative embodiments, any suitable means could be used to receive and analyze the output of internal potentiometer 74.

Figure 6:
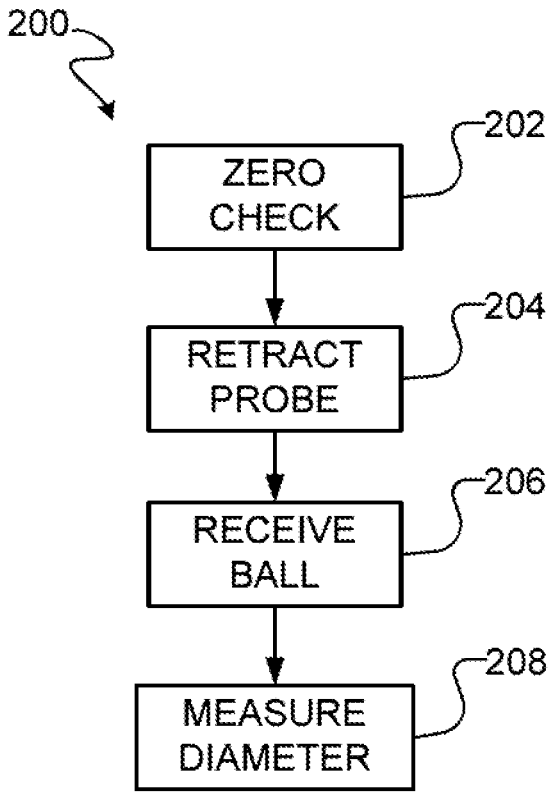
FIG. 6 is an example embodiment of a method for sizing a drop ball.

With reference to FIG. 6, an example embodiment of a method 200 of sizing a drop ball is Illustrated. At step 202, a measuring probe is moved to its fully extended position within a measuring chamber to ensure that there is no drop ball present in the measuring chamber and/or to calibrate the measuring probe to its zero position measurement.

At step 204, the measuring probe is retracted so that a drop ball can be received in the measuring chamber.

At step 206, a drop ball is released in any suitable manner, for example from a drop ball launcher stack, so that the drop ball is received in the measuring chamber.

At step 208, the measuring probe is moved downstream until it contacts the drop ball within the measuring chamber. The diameter of the drop ball is then measured.

Figure 7:
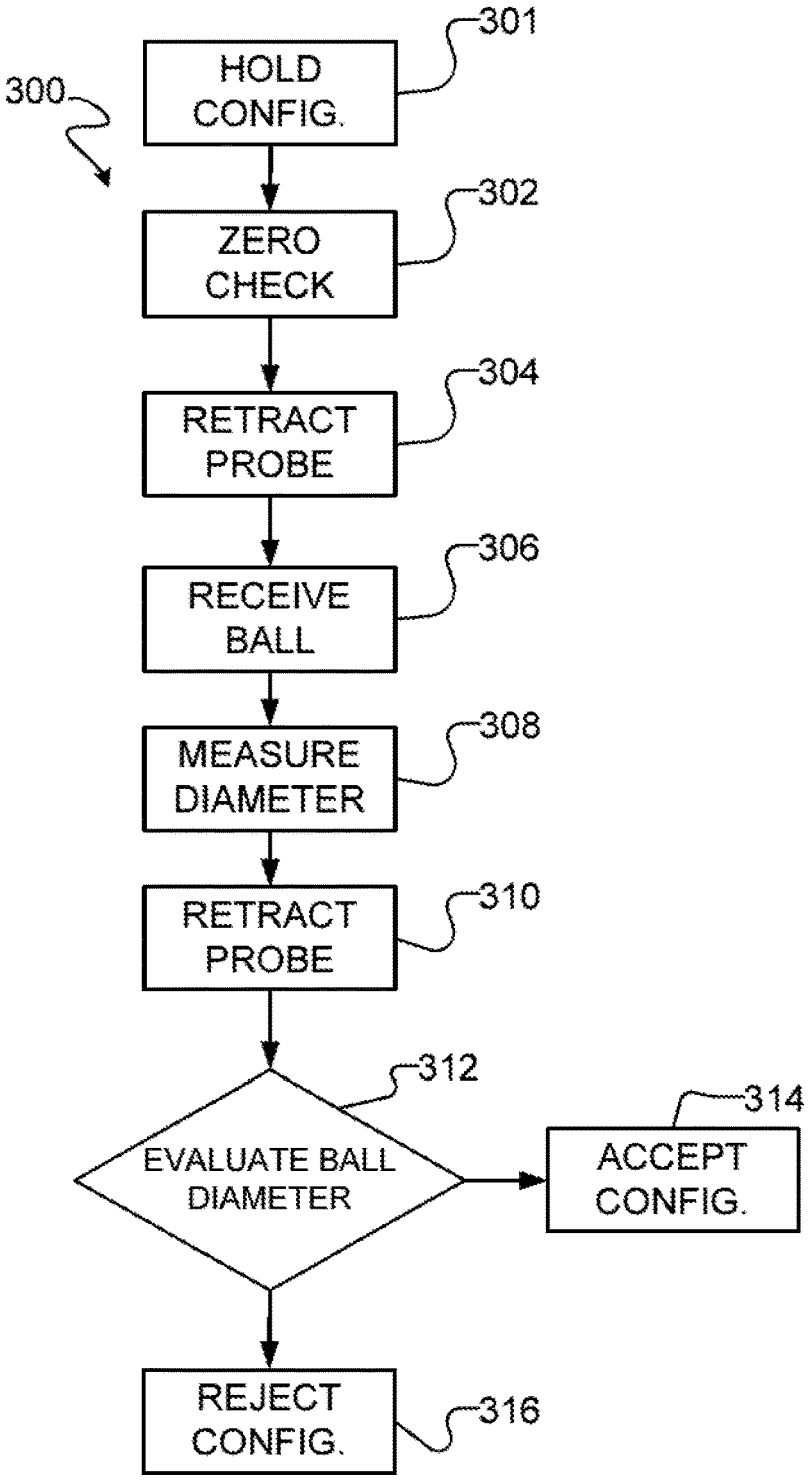
FIG. 7 is an example embodiment of a method for sizing a drop ball and either accepting or rejecting the drop ball.

With reference to FIG. 7, an example embodiment of a method 300 of accepting or rejecting a drop ball is Illustrated. Steps of method 300 that correspond to steps of method 200 are illustrated with reference numerals that have been incremented by 100, and are not further described again.

At step 301, a drop ball acceptance/rejection unit is placed into the hold configuration to receive a drop ball. Steps 302, 304, 306 and 308 are carried out as described above for method 200 to measure the diameter of the drop ball that is introduced into the drop ball acceptance/rejection unit.

At step 310, the measuring probe is retracted so that the drop ball can move freely within the measuring chamber.

At step 312 the diameter of the drop ball is evaluated and compared to the expected diameter of the drop ball. If the diameter of the drop ball is the same as the expected diameter, then at step 314, the drop ball acceptance/rejection unit is moved to the accept configuration to accept the drop ball.

If at step 312 it is determined that the diameter of the drop ball Is different than the expected diameter, then at step 316, the drop ball acceptance/rejection unit is moved to the reject configuration to reject the drop ball.

Figure 8:
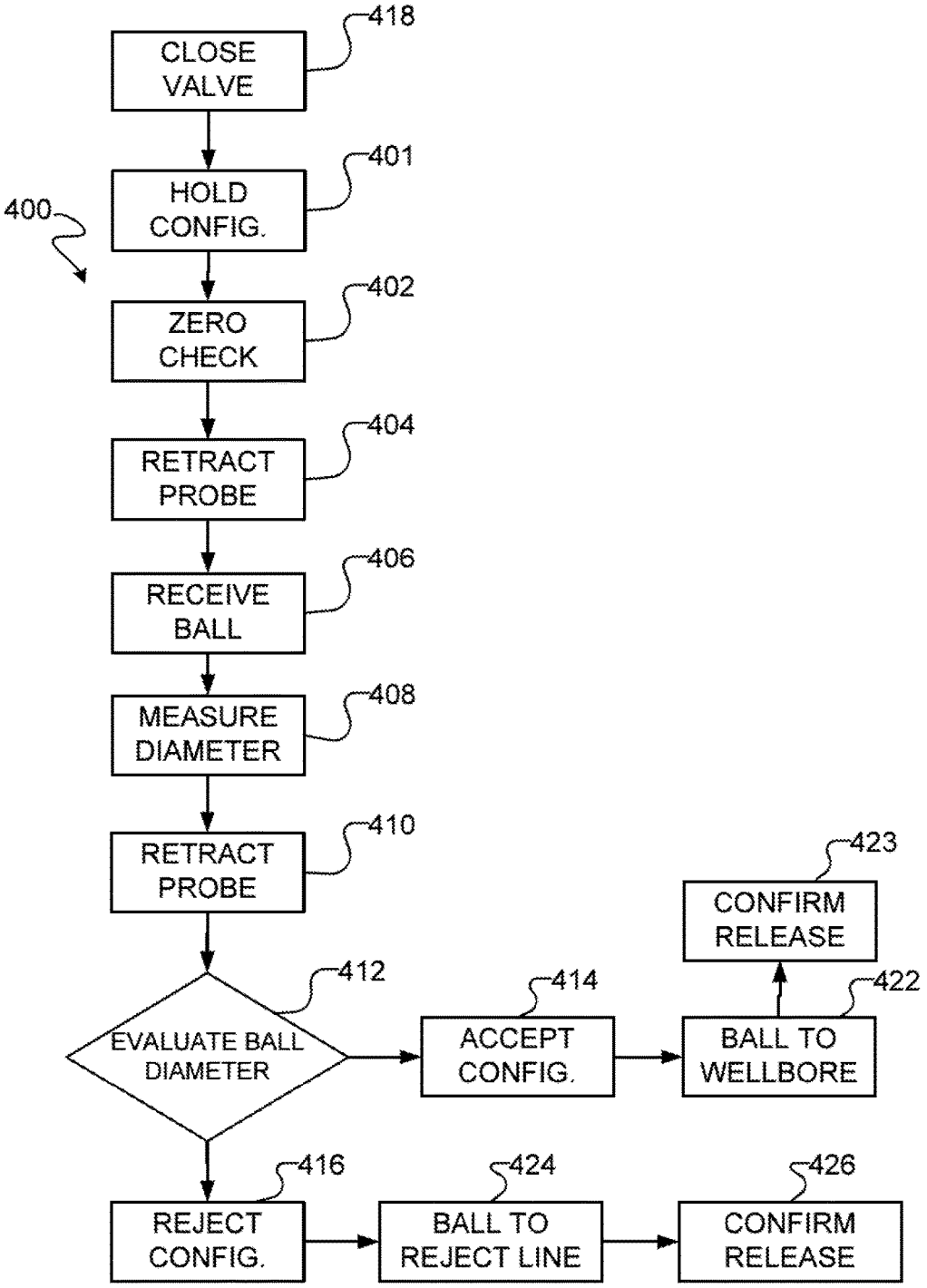
FIG. 8 is an example embodiment of a method for introducing a drop ball into an oil or gas well and confirming the diameter of the drop ball before releasing the drop ball into the wellbore.

With reference to FIG. 8, an example embodiment of a method 400 for Injecting a drop ball into a wellbore is described. Steps of method 400 that correspond to steps of method 300 are illustrated with reference numerals that have been incremented by 100, and are not further described again.

At step 418, the main isolation valve of the well is closed. At step 401, a drop ball acceptance/rejection unit is placed into the hold configuration to receive a drop ball for Injection into the wellbore, for example from a drop ball launcher. Steps 402, 404, 406, 408, and 412 are carried out as described above for steps 302, 304, 306, 308 and 312 to determine if the drop ball has the desired diameter to be introduced into the wellbore.

At step 412 it is determined whether the diameter of the drop ball is the expected diameter, i.e. the diameter of the drop ball that is to be injected into the wellbore. If the diameter of the drop ball is the same as the expected diameter, then at step 414, the drop ball acceptance/rejection unit is moved to the accept configuration to accept the drop ball. At step 422, the drop ball is then introduced into the wellbore. The main isolation valve of the well is opened and the pressure in the drop ball sizing apparatus is raised to a pressure greater than or equal to the well treatment pressure to allow the drop ball to be injected into the well. If necessary or desired, the well treatment pressure may be decreased to inject the drop ball into the well. At step 423, the measuring probe is optionally extended to its fully extended or zero check configuration, to confirm that the drop ball has been released from the measuring chamber.

If at step 412 it is determined that the diameter of the drop ball is different than the expected diameter, i.e. the drop ball has a diameter that is different from the diameter of the drop ball that should be introduced into the wellbore at that point in time, then at step 216, the drop ball acceptance/rejection unit is moved to the reject configuration to reject the drop ball. At step 424, the drop ball is introduced to the reject outlet, so that the drop ball does not enter the wellbore. At step 426, the measuring probe is optionally extended to its fully extended or zero check configuration, to confirm that the drop ball has been released from the measuring chamber.

Figure 9A:
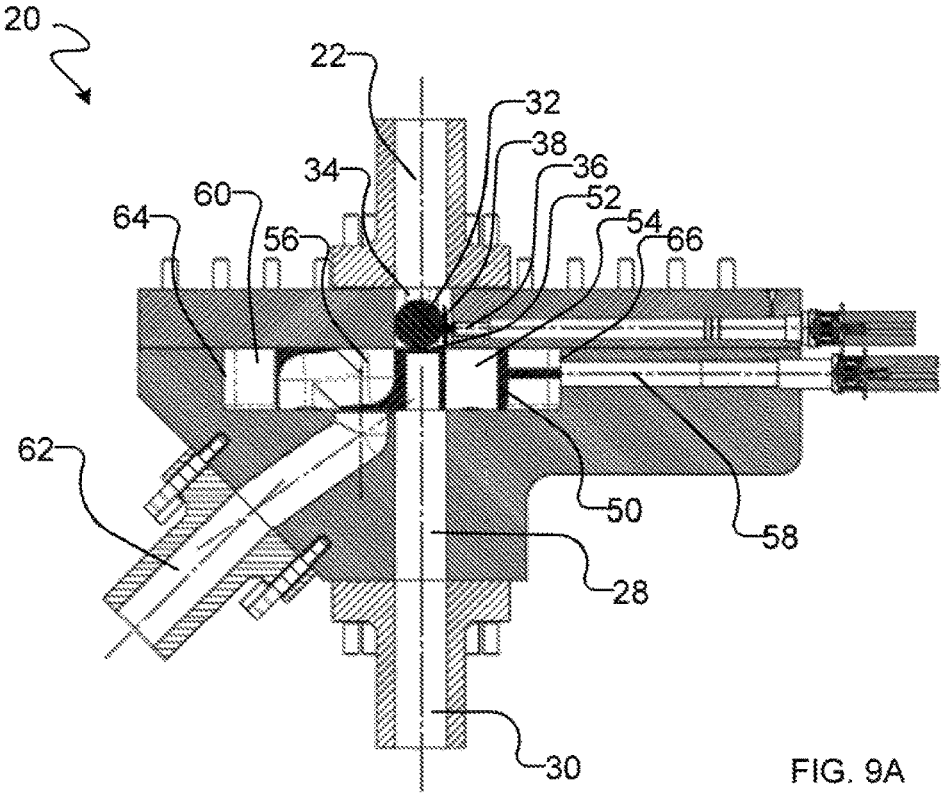
FIGS. 9A, 9B and 9C illustrate a method of operating a drop ball sizing apparatus according to the illustrated embodiment of FIGS. 1-3D to introduce a drop ball having the desired diameter into a wellbore.
Figure 9B:
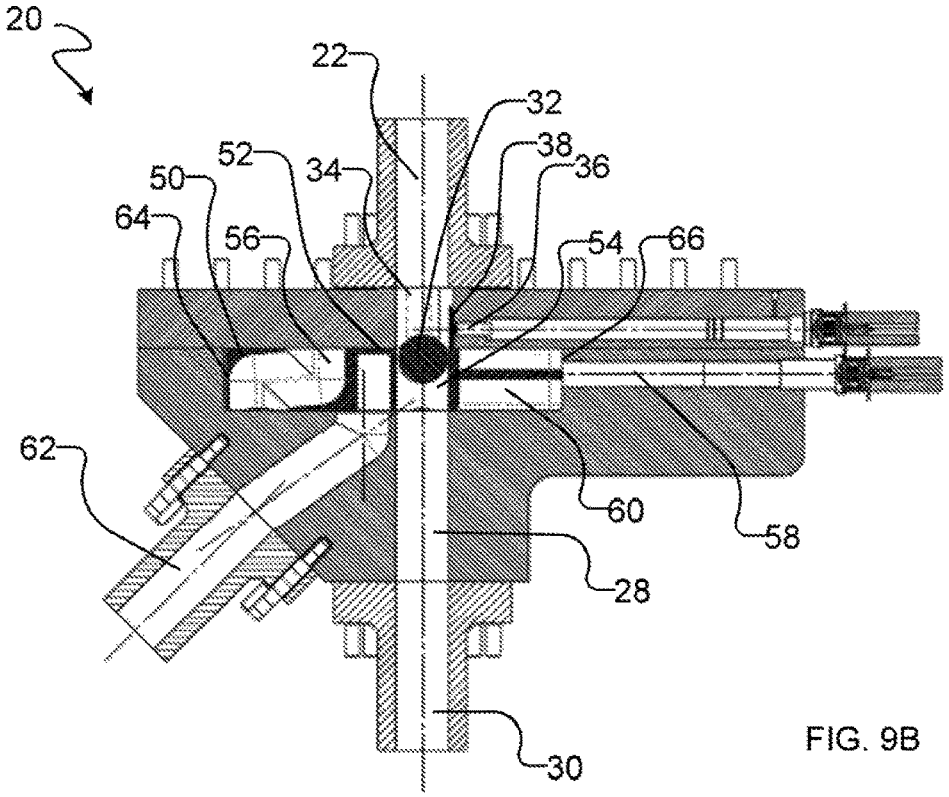
Figure 9C:
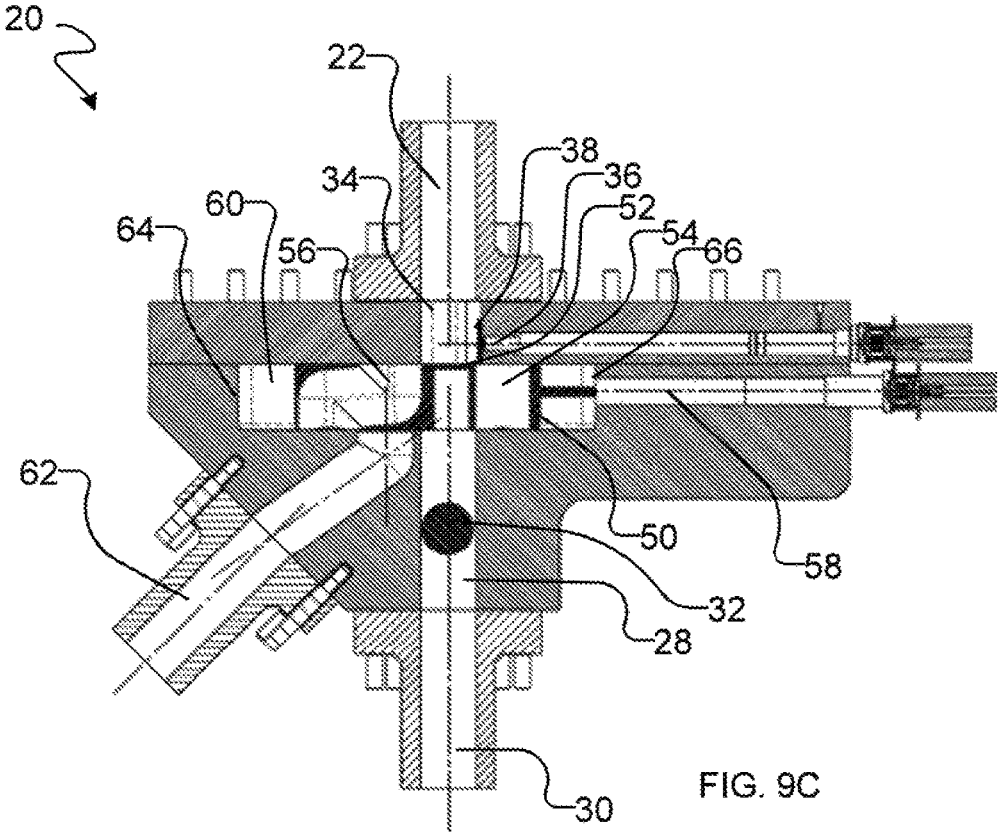

With reference to FIGS. 9A, 9B and 9C, the operation of the embodiment of a drop ball sizing apparatus 20 shown in FIGS. 1-3D to introduce a drop ball having the desired diameter into the wellbore is illustrated in greater detail.

In FIG. 9A, measuring piston 36 is shown in its measuring position to measure the outer diameter of a drop ball 32 that has been received in measuring chamber 34. Drop ball sizing unit 24 determines that the drop ball 32 has the desired predetermined outer diameter.

Because drop ball 32 has the desired predetermined outer diameter, as shown in FIG. 9B, drop ball acceptance/rejection unit 26 is accordingly moved to the accept configuration by actuating selector plate 50. In the illustrated embodiment, selector plate 50 is actuated in the downstream direction so that through pass channel 54 is aligned with both measuring chamber 34 and drop ball outlet 28. Drop ball 32 is thus allowed to move past support panel 52, and can enter through pass channel 54.

As seen in FIG. 9C, drop ball 32 can continue to move downwardly through drop ball outlet 28 and into wellbore 30. The main isolation valve of the well is opened and the pressure in drop ball sizing apparatus 20 is raised to a pressure greater than or equal to the well treatment pressure to allow the drop ball 32 to be injected into the well. If necessary or desired, the well treatment pressure can be decreased to inject the drop ball 32 into the well.

With reference to FIGS. 10A, 10B, 10C, 10D and 10E, the operation of the embodiment of a drop ball sizing apparatus 20 shown in FIGS. 1-3D to prevent a drop ball that does not have the desired diameter from entering the wellbore is illustrated in greater detail.

Figure 10A:
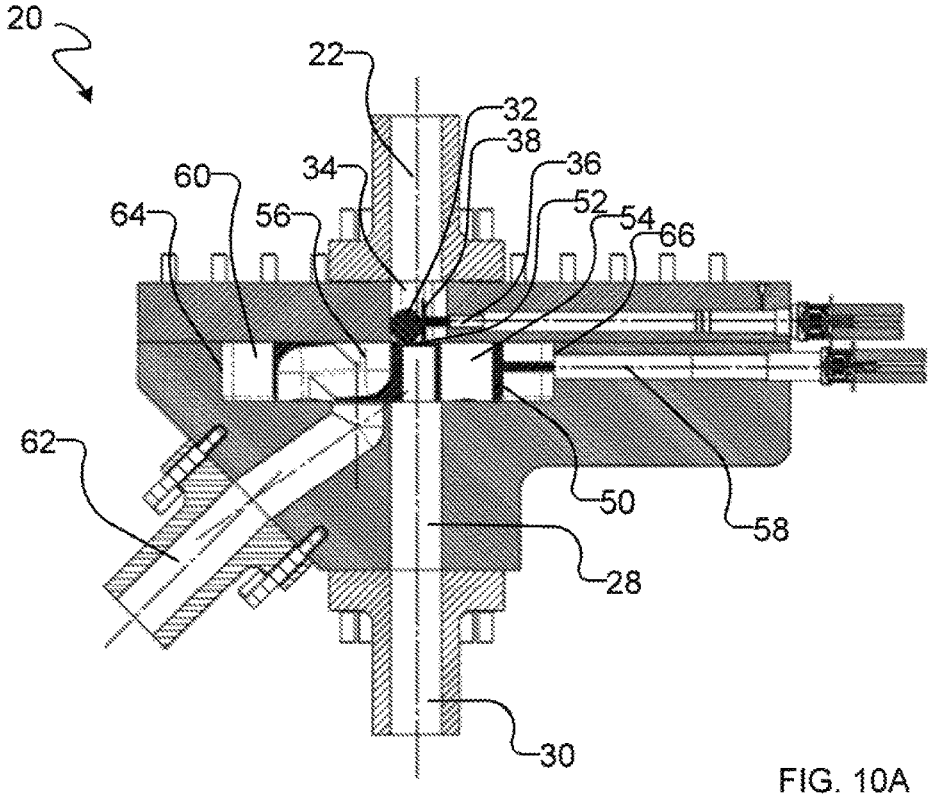
FIGS. 10A, 10B, 10C, 10D and 10E illustrate a method of operating a drop ball sizing apparatus according to the illustrated embodiment of FIGS. 1-3D to prevent a drop ball that does not have the desired diameter from entering a wellbore.

In FIG. 10A, measuring piston 36 is shown in its measuring position to measure the outer diameter of a drop ball 32 that has been received in measuring chamber 34. Drop ball sizing unit 24 determines that the drop ball 32 does not have the desired predetermined outer diameter.

Figure 10B:
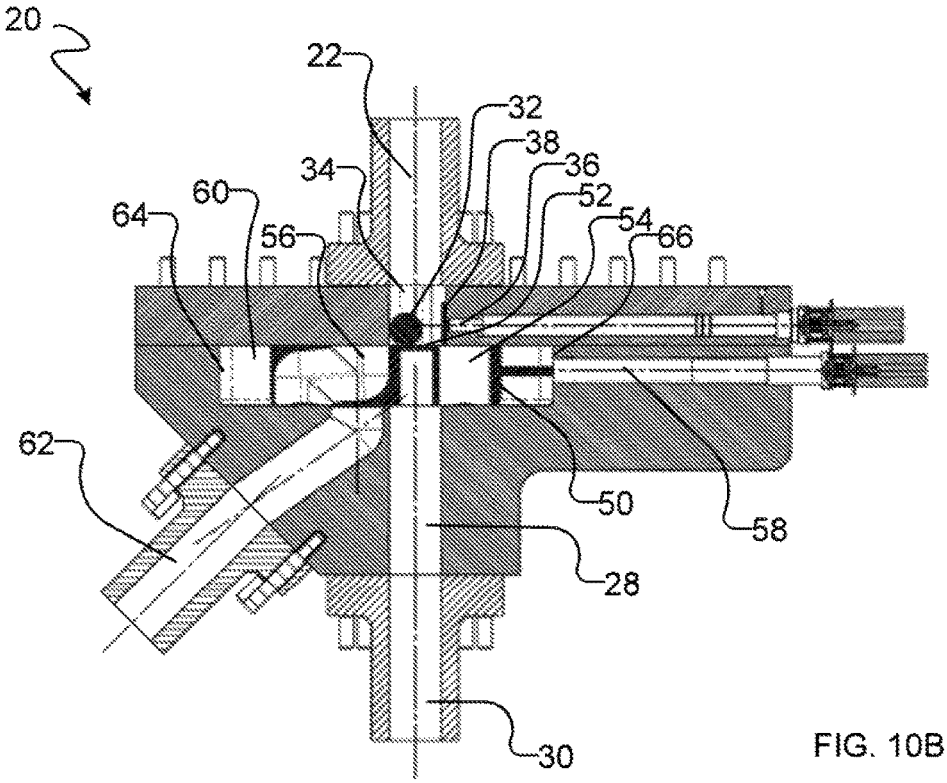

In FIG. 10B, measuring piston 36 is moved from its measuring position to its retracted position, so that drop ball 32 will be able to freely travel from measuring chamber 34.

Figure 10C:
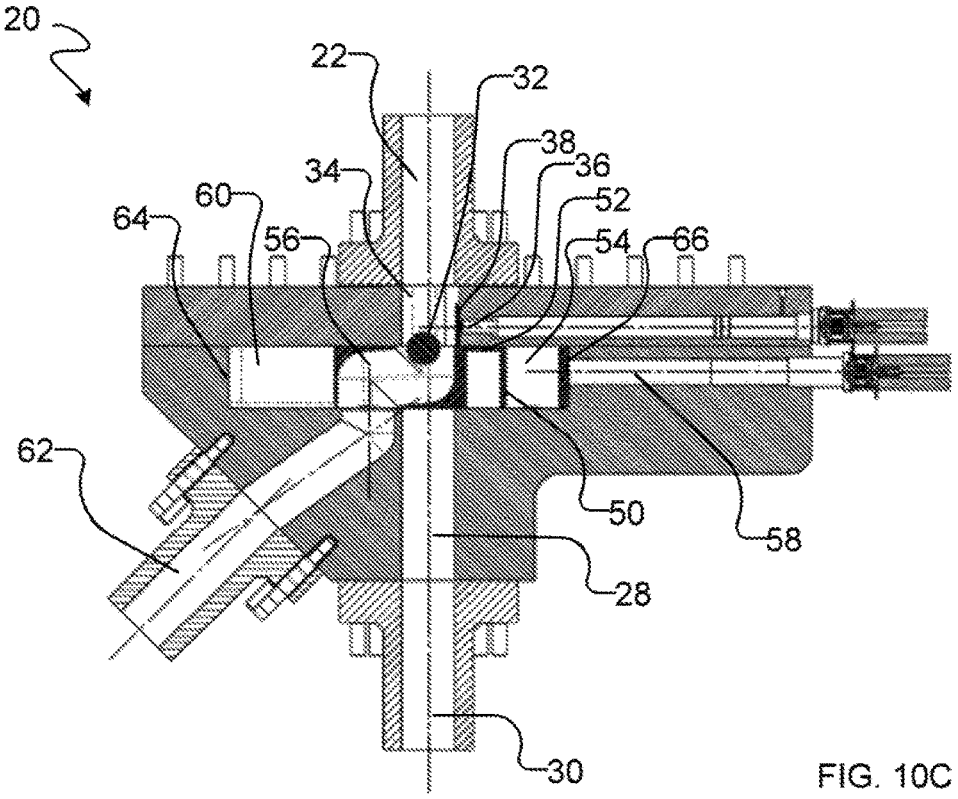

Because drop ball 32 does not have the desired predetermined outer diameter, as shown in FIG. 10C, drop ball acceptance/rejection unit 26 is accordingly moved to the reject configuration by actuating selector plate 50. In the illustrated embodiment, selector plate 50 is actuated in the upstream direction so that reject channel 56 is aligned with both measuring chamber 34 and reject outlet 62. Drop ball 32 is thus allowed to move past support panel 52, and can enter reject channel 56.

Figure 10D:
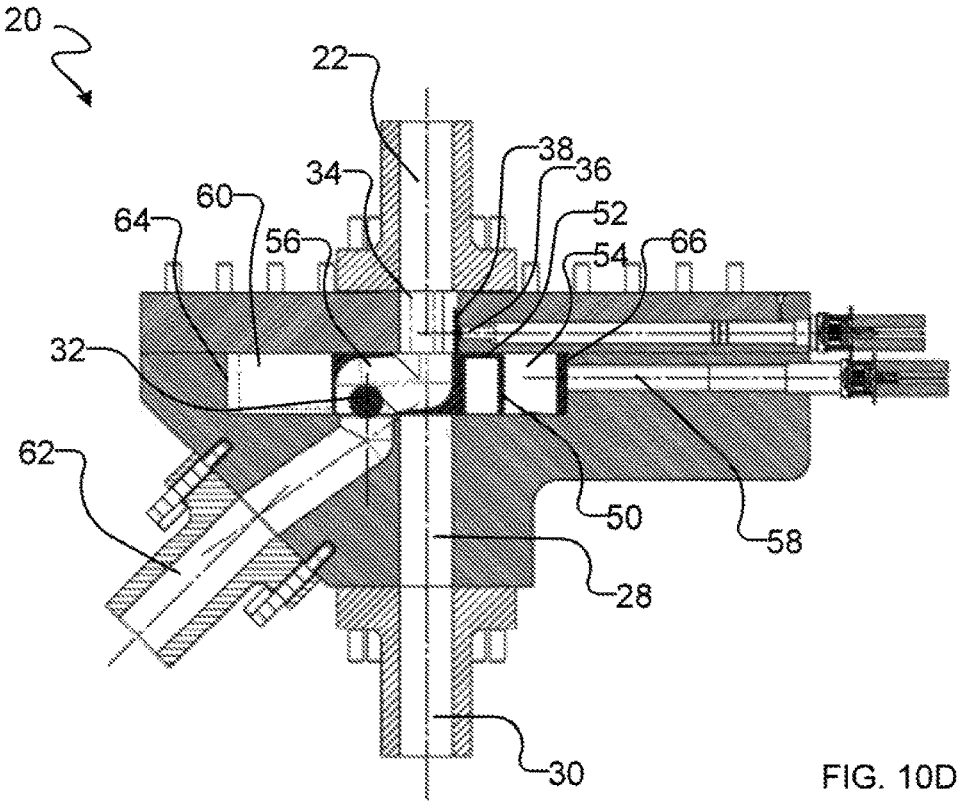
Figure 10E:
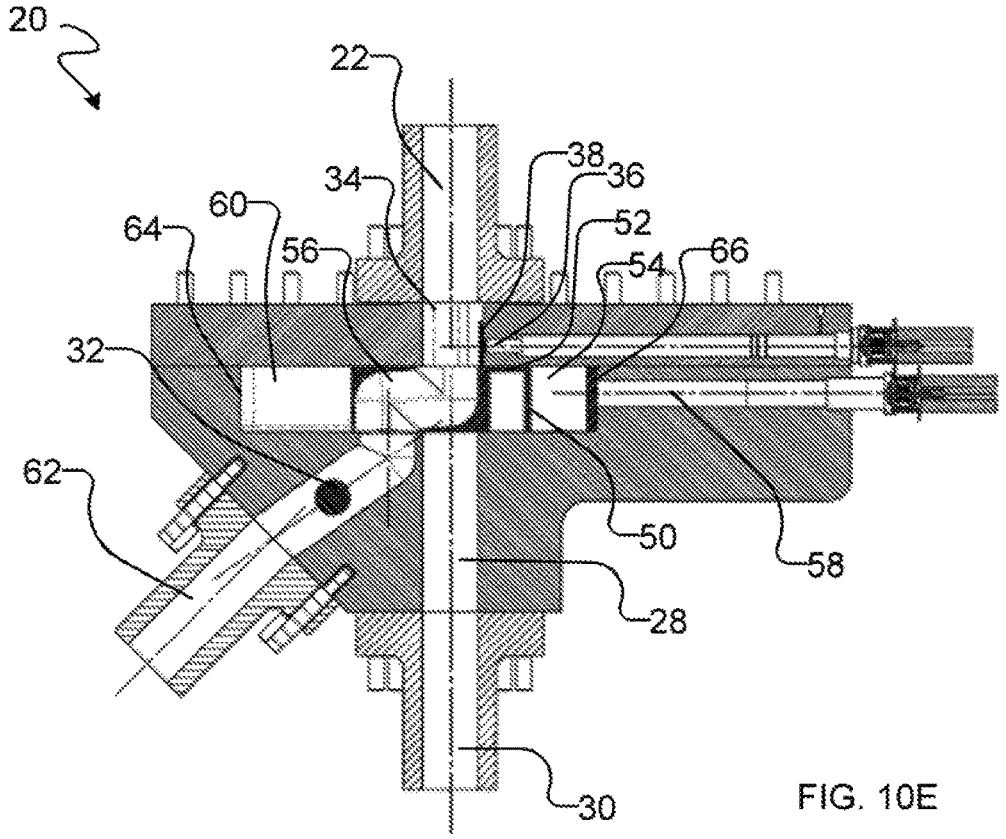

As shown in FIGS. 10D and 10E, drop ball 32 can continue to move through reject channel 56 and out through reject outlet 62. The drop ball 32 having the incorrect diameter is accordingly prevented from entering wellbore 30.

In some embodiments, a mechanical position indicator is provided to give a visual indication of whether a drop ball has been Introduced into the wellbore or rejected. With reference to FIGS. 11A, 11B, 11C, 11D, 11E and 11F, an example embodiment of a mechanical position indicator 160 is illustrated. Mechanical position indicator 160 has a back plate 162, a front plate 164, and a pin 166 that travels within a linear slot 1688 formed in back plate 162 in the directions indicated by arrow 167.

Pin 166 is connected to move in tandem with selector plate 50, i.e. movement of the selector plate 50 in the downstream direction causes a corresponding movement of pin 166 in the downstream direction (i.e. to the left in the illustrated embodiment of FIGS. 11A-11F), and movement of selector plate 50 in the upstream direction causes a corresponding movement of pin 166 in the upstream direction (i.e. to the right in the illustrated embodiment of FIGS. 11A-11F).

Pin 166 also travels within an articulated slot 170 that is formed in front plate 164. Articulated slot 170 provides a path of travel for pin 166 that begins at a starting point 180 positioned roughly at a laterally and longitudinally central portion of front plate 164 when selector plate 52 is in the hold configuration (i.e. when a drop ball 32 is being supported within measuring chamber 34).

A first endpoint 182 of articulated slot 170 is laterally spaced apart from starting point 180 in a first lateral direction (upwardly in the illustrated embodiment of FIGS. 11A-11F) and longitudinally spaced apart from starting point 180 in the upstream direction. A second endpoint 184 of articulated slot 170 is laterally spaced apart from starting point 180 in a second lateral direction that is opposite to the first lateral direction (downwardly in the illustrated embodiment of FIGS. 11A-11F) and longitudinally spaced apart from starting point 180 in the downstream direction. Articulated slot 170 is shaped and configured to provide a smooth path of travel for pin 166 to slide smoothly between first and second endpoints 182 and 184.

Front plate 164 is hingedly mounted to back plate 162 via a pivot point 174 so that front plate 164 can be rotated as pin 166 travels linearly within linear slot 168. An indicator 172 is also pivotably mounted to back plate 162 via a second pivot point 175, and engaged via interlocking gears 176 with corresponding gears 178 provided on front plate 164 so that rotation of front plate 164 also causes a corresponding rotation of indicator 172.

Figure 11A:
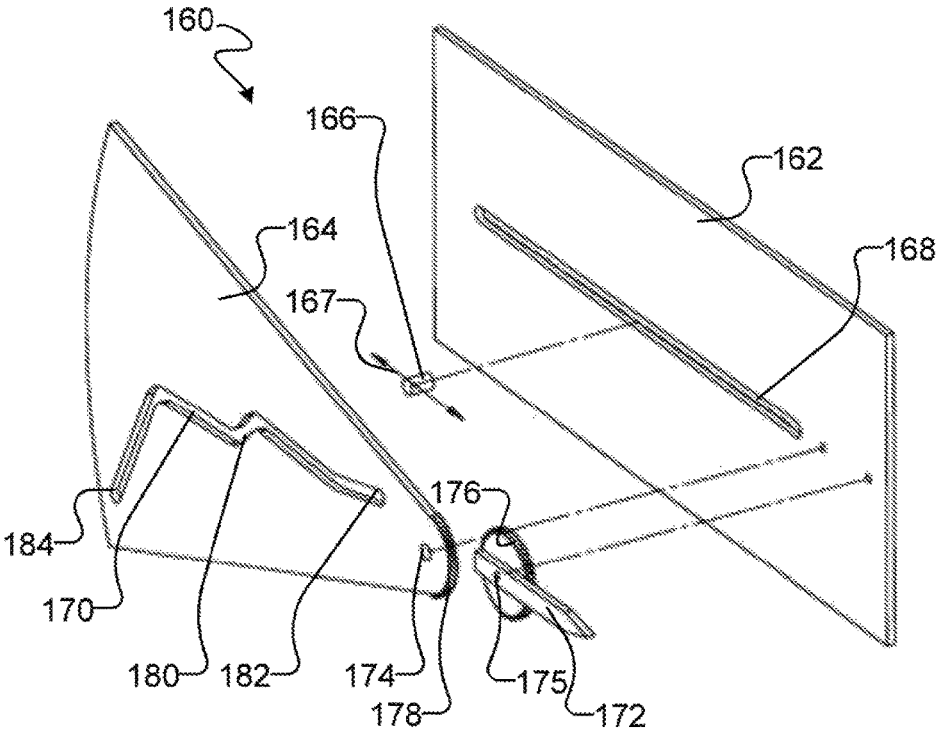
FIGS. 11A, 11B, 11C, 11D, 11E and 11F illustrate an example embodiment of a mechanical indicator that can be used in conjunction with some embodiments to provide a visual indication that a drop ball has entered the wellbore or been rejected.
Figure 11B:
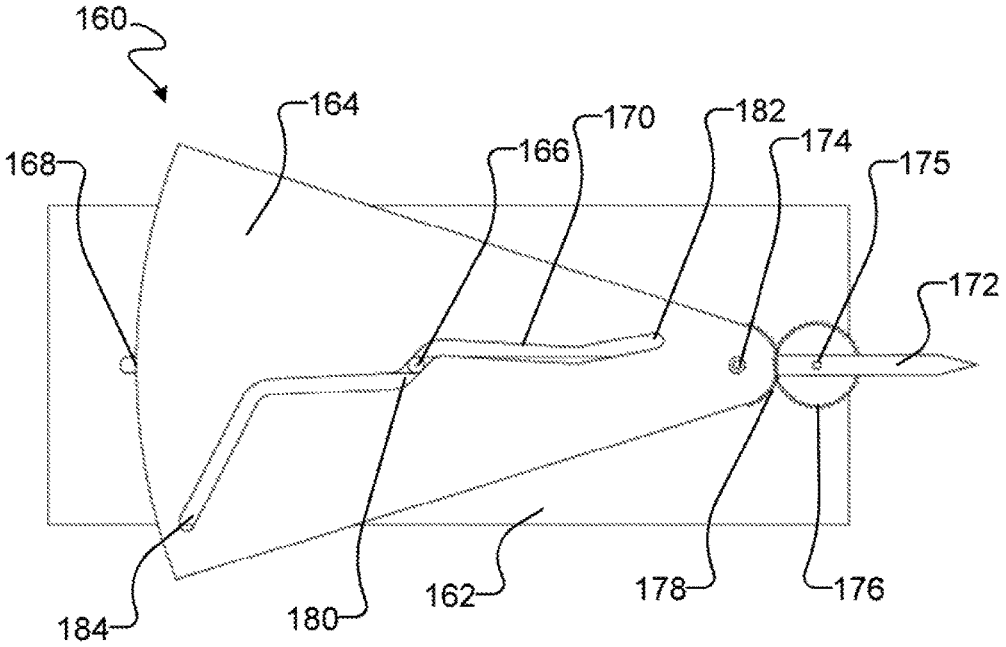

In the position shown in FIG. 11B, pin 166 is in its central position at starting point 180 of articulated slot 170, which corresponds to drop ball acceptance/rejection unit 26 being in the hold configuration, to receive and support a drop ball 32 within measuring chamber 34. Indicator 172 is accordingly in a horizontal position, indicating that drop ball acceptance/rejection unit 26 is in its hold configuration, so that drop ball sizing unit 24 is ready to receive a drop ball 32 for sizing.

Figure 11C:
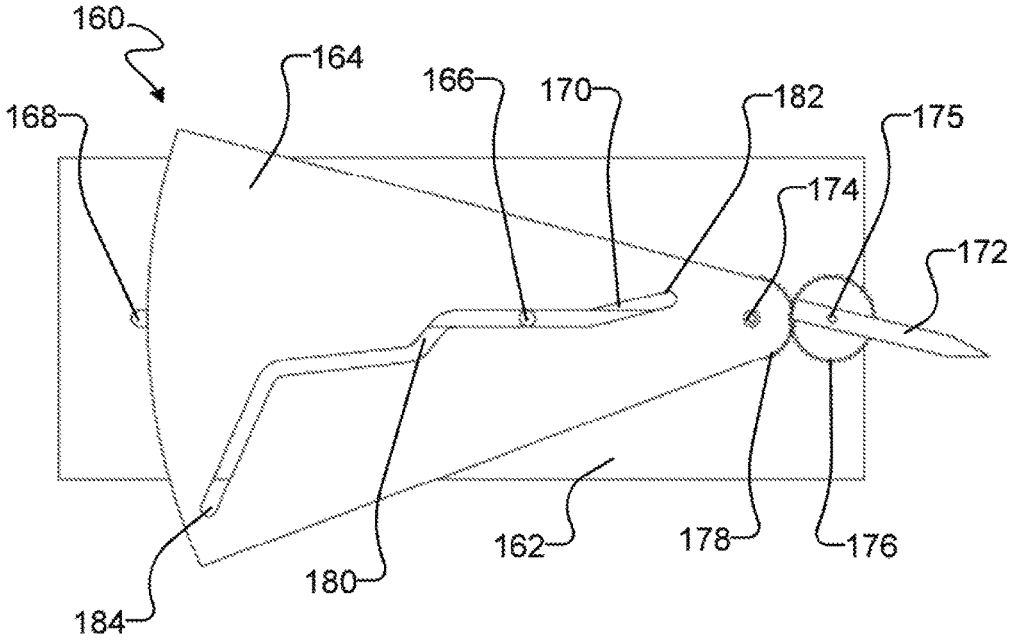

In the position shown in FIG. 11C, drop ball sizing unit 24 has determined that the drop ball 32 has the desired diameter, and drop ball acceptance/rejection unit 26 is being actuated to the accept configuration so that drop ball 32 will be released through pass channel 54 into the wellbore 30. Front plate 164 starts to rotate as pin 166 slides upstream within linear slot 168, and correspondingly between starting point 180 and first endpoint 182 of articulated slot 170, so that indicator 172 correspondingly starts to rotate downward via the interaction of interlocking gears 176, 178.

Figure 11D:
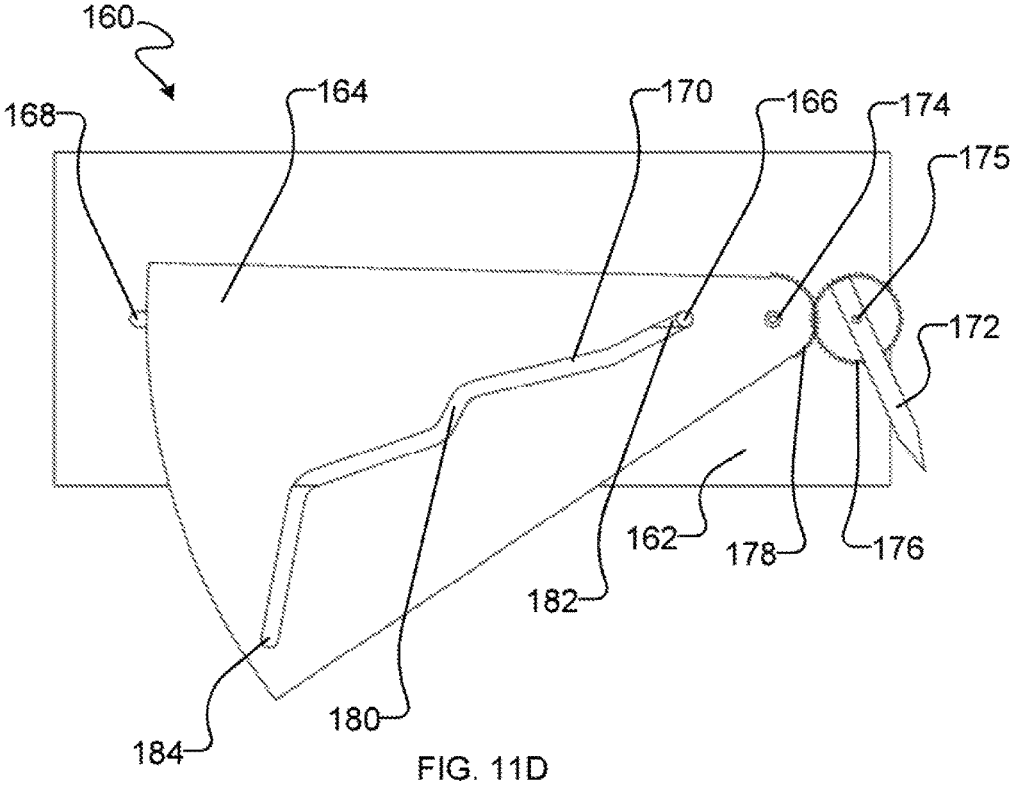

As shown in FIG. 11D, once selector plate 50 of drop ball acceptance/rejection unit 26 has moved fully to the accept configuration, pin 166 has slid fully upstream within linear slot 168 and articulated slot 170 to first endpoint 182, and front plate 164 is fully rotated to cause a corresponding rotation of indicator 172 into a hard downward position via the interaction of interlocking gears 176, 178. This movement provides a visible signal that the drop ball 32 has been released into the wellbore 30.

Figure 11E:
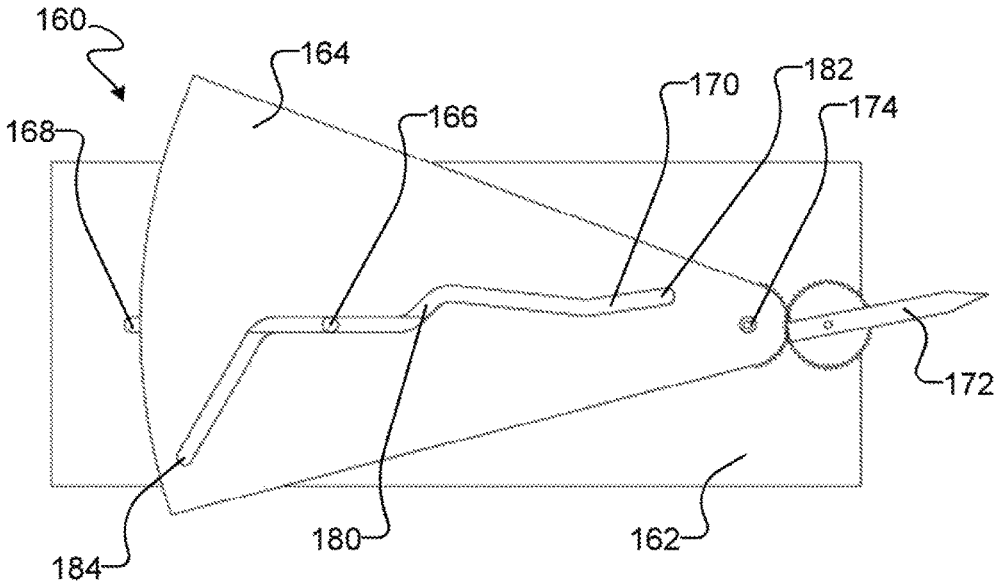

FIG. 11E shows a scenario in which drop ball sizing unit 24 has determined that the drop ball 32 does not have the desired diameter. Drop ball acceptance/rejection unit 26 is accordingly being actuated to the reject configuration so that drop ball 32 will be released through reject channel 56 and out reject outlet 62. Thus, drop ball 32 will be prevented from entering wellbore 30. In this circumstance, front plate 164 again starts to rotate, but in the opposite direction from indicating acceptance, as pin 166 slides downstream within linear slot 168 and articulated slot 170 from starting point 180 towards second endpoint 184, so that Indicator 172 correspondingly starts to rotate upward.

Figure 11F:
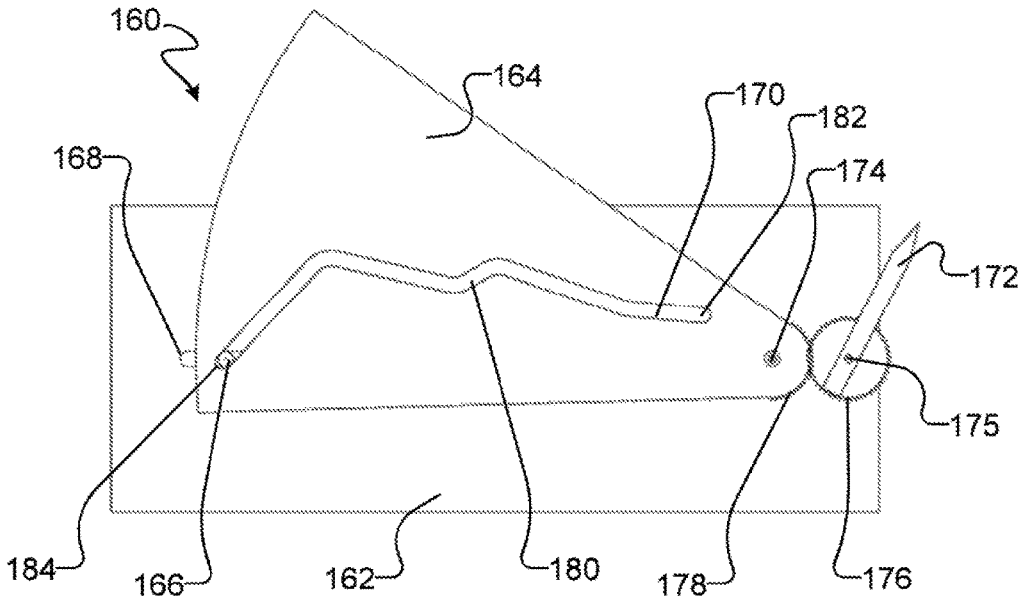

FIG. 11F shows mechanical position indicator 160 after selector plate 50 of drop ball acceptance/rejection unit 26 has moved fully to the reject position. At this point, pin 166 has slid fully downstream within linear slot 168 and articulated slot 170 to second endpoint 184 and front plate 164 is fully rotated, but in the opposite direction from Indicating acceptance, causing a corresponding rotation of indicator 172 into a hard up position via the interaction of interlocking gears 176, 178. This movement provides a visible signal that drop ball 32 has been rejected and has been prevented from entering wellbore 30.

While a number of exemplary aspects and embodiments have been discussed above, those of skill in the art will recognize certain modifications, permutations, additions and sub-combinations thereof.

For example and without limitation, in some embodiments, the reject channel 56 and reject outlet 62 of drop ball acceptance/rejection unit 26 are omitted. In such embodiments, if it is determined that the drop ball 32 does not have the correct diameter, it would be necessary to shut-in the well and retrieve drop ball 32, to prevent a drop ball of the incorrect diameter entering the well.

As a further example, while an exemplary embodiment of a mechanical position indicator 160 has been described and illustrated herein, in other embodiments, a visual indication that a drop ball has or has not entered the wellbore can be provided by actuating a coloured indicator, activating/deactivating lights, or any other suitable means that can show a visual variation to an observer from a working distance.

It is therefore intended that the following appended claims and claims hereafter introduced are interpreted to include all such modifications, permutations, additions and sub-combinations as are consistent with the broadest interpretation of the specification as a whole.

The invention claimed is:

1. An apparatus for introducing a drop ball into a wellbore, the apparatus comprising:

an inlet;

an outlet that can be placed in fluid communication with both the inlet and the wellbore;

a measuring chamber interposing the inlet and the outlet;

a ball release support positioned to initially support the drop ball within the measuring chamber and actuable to allow the drop ball to move from the measuring chamber to the wellbore via the outlet;

a measuring piston actuable to contact an edge of the drop ball within the measuring chamber; and a measuring unit for measuring a displacement of the measuring piston between an initial position of the measuring piston and a point where the measuring piston contacts the edge of the drop ball within the measuring chamber to measure a diameter of the drop ball.

2. The apparatus as defined in claim 1, wherein the ball release support is provided as a component of a drop ball acceptance or rejection unit, the drop ball acceptance or rejection unit having a through pass channel positioned on a first side of the ball release support, the drop ball acceptance or rejection unit being actuable to independently align each of the ball release support and the through pass channel with the measuring chamber so that when the ball release support is aligned with the measuring chamber, the drop ball is retained within the measuring chamber, and when the through pass channel is aligned with the measuring chamber, the drop ball can pass into the wellbore.

3. The apparatus as defined in claim 2, comprising a second actuator engaged to actuate the drop ball acceptance or rejection unit.

4. The apparatus as defined in claim 3, wherein the first actuator and the second actuator independently comprise an electric, hydraulic or pneumatic actuator.

5. The apparatus as defined in claim 3, wherein the first actuator and the second actuator are independently actuated by a mechanical actuator, a magnetic actuator, or manually.

6. The apparatus as defined in claim 5, wherein the first actuator comprises a mechanical actuator, wherein the mechanical actuator comprises:

an electric motor;

a first gear wheel operatively coupled to be rotated by the electric motor;

a second gear wheel engaged to be rotated by rotation of the first gear wheel;

a captive roller nut supported against longitudinal or lateral movement by a housing, the captive roller nut being operatively engaged to be rotated by rotation of the second gear wheel; and a threaded shaft portion in threaded engagement with the captive roller nut and supported against lateral and rotational movement but being longitudinally moveable in response to rotation of the captive roller nut;

the threaded shaft portion being engaged to move the measuring piston in the longitudinal direction to extend and retract the measuring piston.

7. The apparatus as defined in claim 6, comprising a linear potentiometer positioned to measure longitudinal displacement of the threaded shaft portion, wherein the threaded shaft portion is fixedly engaged to the measuring piston.

8. The apparatus as defined in claim 6, wherein the threaded shaft portion is supported against rotational movement by engagement with an anti-rotation key plate, the anti-rotation key plate being slidable within a slot formed within an external housing of the mechanical actuator.

9. The apparatus as defined in claim 6, wherein the second actuator comprises a mechanical actuator, wherein the mechanical actuator comprises:

an electric motor;

a first gear wheel operatively coupled to be rotated by the electric motor;

a second gear wheel engaged to be rotated by rotation of the first gear wheel;

a captive roller nut supported against longitudinal or lateral movement by a housing, the captive roller nut being operatively engaged to be rotated by rotation of the second gear wheel; and a threaded shaft portion in threaded engagement with the captive roller nut and supported against lateral and rotational movement but being longitudinally moveable in response to rotation of the captive roller nut;

the threaded shaft portion being fixedly engaged with the drop ball acceptance or rejection unit to move the drop ball acceptance or rejection unit in the longitudinal direction.

10. The apparatus as defined in claim 6, further comprising a mechanism for monitoring a number of rotations of the captive roller nut of the first actuator or a voltage of an electric motor used to drive the first actuator to calculate the longitudinal displacement of the measuring piston.

11. The apparatus as defined in claim 6, comprising an indicator mechanism for confirming whether a drop ball has been introduced into the wellbore, the indicator mechanism comprising:

a rear plate having a longitudinally extending straight slot defined therein;

a front plate having an articulated slot defined therein, the front plate being rotatably mounted to the rear plate;

a pin engaged to move longitudinally with the drop ball acceptance or resection unit; and an indicator positioned to be rotated by rotation of the front plate.

12. The apparatus as defined in claim 11, wherein a first end of the articulated slot is spaced apart from a central portion of the articulated slot in both a first lateral direction and a first longitudinal direction, and a second end of the articulated slot is spaced apart from the central portion in both a second lateral direction that is opposite to the first lateral direction and a second longitudinal direction that is opposite to the first longitudinal direction, the pin being smoothly slidable within both the articulated slot and the linear slot to move from the first end to the second end of the articulated slot.

13. The apparatus as defined in claim 12, wherein movement of the pin to the first end of the articulated slot causes the front plate to rotate in the first direction, to thereby cause the indicator to rotate in the first direction, and wherein movement of the pin to the second end of the articulated slot causes the front plate to rotate in the second direction, to thereby cause the indicator to rotate in the second direction.

14. The apparatus as defined in claim 11, wherein the indicator comprises a first set of gears and the front plate comprises a second set of gears positioned and configured to engage with the first set of gears, so that rotation of the second set of gears rotates the first set of gears, thereby rotating the indicator.

15. The apparatus as defined in claim 2, wherein the drop ball acceptance or rejection unit further comprises a reject channel positioned on a second side of the ball release support, the drop ball acceptance or rejection unit being actuable to also independently align the reject channel with the measuring chamber so that, when the reject channel is aligned with the measuring chamber, the drop ball can pass out of the measuring chamber but is prevented from entering the wellbore.

16. The apparatus as defined in claim 1, wherein the ball release support comprises a ported floor.

17. The apparatus as defined in claim 1, wherein the measuring piston comprises a longitudinally extensible arm and a generally planar measuring bar positioned at a downstream end of the arm.

18. The apparatus as defined in claim 1, wherein the longitudinally extensible arm of the measuring piston can be extended to make contact with a downstream surface of the measuring chamber.

19. The apparatus as defined in claim 18, wherein a plane defined by the generally planar measuring bar of the measuring piston and a plane defined by the downstream surface of the measuring chamber at a point of contact with the measuring bar are generally parallel.

20. The apparatus as defined in claim 1, wherein the measuring unit is configured to measure the displacement of the measuring piston in the longitudinal direction.

21. The apparatus as defined in claim 20, wherein the measuring unit is configured to measure displacement of the measuring piston in the longitudinal direction by measuring the longitudinal displacement of the measuring bar or any other component connected in fixed relation to the measuring piston or the measuring bar.

22. The apparatus as defined in claim 20, wherein the measuring unit comprises a linear potentiometer.

23. The apparatus as defined in claim 1, wherein the measuring unit comprises or further comprises an electromagnetic sensor or an ultrasonic sensor.

24. The apparatus as defined claim 1, wherein the measuring unit comprises a linear variable differential transformer, a combination of a stepper motor with a threaded shaft and the use of a tachometer and encoder, a mechanical measuring device, or a measurement of a hydraulically displaced volume of a hydraulic actuator.

25. The apparatus as defined claim 1, comprising a first actuator engaged to actuate the measuring piston.

26. The apparatus as defined in claim 25, wherein the measuring piston is mounted in a spring loaded fashion within an inner sleeve positioned within the first actuator, and wherein an internal potentiometer is provided to measure the displacement of the measuring piston relative to the inner sleeve.

27. A method of injecting a drop ball into a wellbore using an apparatus as defined in claim 1, the method comprising the steps of:

ascertaining a desired diameter of the drop ball to be injected into the wellbore;

providing the drop ball to the measuring chamber of the apparatus through the inlet;

initially holding the drop ball in the measuring chamber using the ball release support;

actuating the measuring piston to contact the edge of the drop ball and force the drop ball against a downstream surface of the measuring chamber and measuring the displacement of the measuring piston between the initial position of the measuring piston and the point where the measuring piston contacts the edge of the drop ball within the measuring chamber to measure the diameter of the drop ball;

evaluating whether the drop ball has the desired diameter and;

if the drop ball has the desired diameter, releasing the drop ball from the measuring chamber into the wellbore by actuating the ball release support to allow the drop ball to move from the measuring chamber to the wellbore via the outlet.

28. The method of injecting a drop ball into a wellbore as defined in claim 27, further comprising, if the drop ball does not have the desired diameter, releasing the drop ball from the measuring chamber through a reject channel so that the drop ball is prevented from entering the wellbore.

29. The method of injecting a drop ball into a wellbore as defined in claim 27 comprising, prior to providing the drop ball to the measuring chamber, extending the measuring piston to its fully extended configuration.

30. The method of injecting a drop ball into a wellbore as defined in claim 27 comprising, after releasing the drop ball from the measuring chamber, extending the measuring piston to its fully extended configuration.

31. The method of injecting a drop ball into a wellbore as defined in claim 27, comprising measuring a longitudinal displacement of the measuring piston to determine the diameter of the drop ball.

32. The method as defined in claim 31, wherein the longitudinal displacement of the measuring piston is measured using a linear potentiometer.

33. The method as defined in claim 27, wherein the longitudinal displacement of the measuring piston is measured using an electromagnetic sensor or an ultrasonic sensor.

34. The method as defined in claim 27, wherein the longitudinal displacement of the measuring piston is measured or verified by measuring a number of rotations of a roller nut used to actuate the measuring piston or by measuring the voltage of an electric motor used to rotate the threaded shaft portion.

35. The method as defined in claim 27, wherein the longitudinal displacement of the measuring piston is measured using a linear variable differential transformer, a combination of a stepper motor with a threaded shaft and the use of a tachometer and encoder, a mechanical measuring device, or by measuring hydraulically displaced volume of a hydraulic actuator.

36. The method as defined in claim 27, further comprising providing a mechanical indication that the drop ball has been released from the measuring chamber into the wellbore.

37. The method as defined in claim 27, further comprising providing a mechanical indication that the drop ball has been released through the reject channel and has not entered the wellbore.

* * * * *